United States Patent [19]

Kusumoto et al.

[11] Patent Number: 4,841,336

[45] Date of Patent: Jun. 20, 1989

[54] IMAGE FORMING APPARATUS WITH DEVELOPING DEVICE ACCOMMODATING MEANS

[75] Inventors: Toshihiko Kusumoto, Tokyo; Toshirou Kasamura, Yokohama; Naoki Okuda, Kawasaki; Masashi Ohashi, Tokyo; Nobukazu Sasaki, Yokohama; Minoru Nada, Kawasaki, all of Japan

[73] Assignee: Canon Kabushiki Kaisha, Tokyo, Japan

[21] Appl. No.: 165,934

[22] Filed: Mar. 9, 1988

[30] Foreign Application Priority Data

Mar. 10, 1987 [JP] Japan ..... 62-52901
Mar. 10, 1987 [JP] Japan ..... 62-52913
Mar. 10, 1987 [JP] Japan ..... 62-52924

[51] Int. Cl.[4] ..... G03G 15/01
[52] U.S. Cl. ..... 355/245; 355/326
[58] Field of Search ..... 355/4, 3 DD, 14 D, 3 R, 355/14 R

[56] References Cited

U.S. PATENT DOCUMENTS 4,542,979 9/1985 Percic ..... 355/4
4,593,991 6/1986 Aoki et al. ..... 355/4 X

FOREIGN PATENT DOCUMENTS 66-233669 11/1985 Japan ..... 355/4

*Primary Examiner*—Arthur T. Grimley
*Assistant Examiner*—J. Pendegrass
*Attorney, Agent, or Firm*—Fitzpatrick, Cella, Harper & Scinto

[57] ABSTRACT

A multi-color image forming apparatus, for forming a superimposed multi-color image on a transfer material, includes: a latent image bearing member; device for forming a latent image on the image bearing member; plural developing devices containing different color developers for developing the latent image in different colors; device for accommodating the plural developing devices; guiding device for guiding the developing device between a first position within the accommodating device and a second position adjacent the image bearing member; driving device for moving the developing device between the first position and the second position for exchanging the developing device at the second position; device for discriminating the plural developing devices; and a second developing device disposed adjacent the image bearing member at a different position; wherein when plural colors are selected for development; a discrimination is made as to whether the developing device containing the developer of the selected color is at the first position or not, and if so, the developing device located at the first position is operated before the other of the plural developing devices, irrespective of the order of the selection.

7 Claims, 25 Drawing Sheets

IMAGE FORMING APPARATUS WITH DEVELOPING DEVICE ACCOMMODATING MEANS

FIELD OF THE INVENTION AND RELATED ART

The present invention relates to an image forming apparatus such as a laser beam printer and a copying apparatus, particularly a color image forming apparatus optionally provided with a developing device accommodating apparatus for accommodating a plurality of developing devices.

Recently, the demand for the color image forming apparatus is increasing. To meet this demand, various proposals have been made.

One of such proposals is that a process cartridge containing a developing device only or containing as a unit a photosensitive member as an image bearing member, a cleaning device, a charging means and a developing device is detachably mounted into a main assembly of the image forming apparatus, so that the color of the developer contained in the developing device can be changed by changing the process cartridge. In a second proposal, the main assembly of the image forming apparatus is provided with two developing devices containing different color developers, so that the color thereof can be selected therefrom. In the third proposal, the main assembly of the image forming apparatus is provided with a number of developing devices containing developers having different colors for full-color image formation. The first, second and third proposals are disclosed in, for example, in U.S. Pat. Nos. 4,500,195, 4,710,016 and 4,707,108, respectively.

However, the first system requires a cumbersome developing device exchanging operation whenever the color is to be changed. Additionally, since the exchanging operation requires that the power supply to the apparatus has to be tempolarily shut off, and a cover of the apparatus has to be opened, the total image forming speed is remarkably decreased due to the required additional warming-up time.

The second system does not involve the problem with the first system, since it is not necessary to exchange the developing device in order to change the color (what is require depress the color selection button). However, when a color other than those of the developing devices contained in the apparatus, is desired, there is a necessity of exchanging the developing device contained in the apparatus with a desired one, which is not easy. Therefore, it is still not free from the problem with the first system.

The third system does not involve the problem with the first and second systems, since it contains a number of developing devices containing different color developers. So, it can meet a wide variety of needs for color image formation. Correspondingly, however, it requires wide space to install, and the apparatus becomes bulky. Additionally, even in this system, the developing devices contained in the apparatus are usually for cyan, magenta and yellow, and therefore, when another color is desired, it is still necessary to exchange the developing device.

To obviate those problems, proposals have been made in U.S. Ser. No. 71,316 filed July 9, 1987 and U.S. Ser. No. 111,761 filed Oct. 23, 1987, U.S. Ser. No. 116,957 filed Nov. 5, 1987 which are assigned to the assignee of the present invention. In this system the image forming apparatus is equipped with a developing device accommodating apparatus which is capable of accommodating plural developing devices. The developing devices can be selectively supplied into the main assembly through a transportation passage.

In this system, however, the order of supplying the developing devices into the main assembly is predetermined without any consideration to the order of the developing devices accommodated in the accommodating apparatus. Therefore, the transportation o the developing devices is not always efficient, which results in the decrease of the copy speed, in effect.

SUMMARY OF THE INVENTION

The present invention relates to a further improvement of the last mentioned type, and it is a principal object of the present invention to provide an image forming apparatus in which the transportation of the developing devices into the main assembly is made more efficient to increase the total copy speed.

It is another object of the present invention to provide an image forming apparatus in which a desired developing device can be fed into the main assembly of the image forming apparatus quickly and correctly without making the apparatus bulky.

According to an embodiment of the present invention, there is provided an image forming apparatus having a main assembly including image forming means at its predetermined position and an external developing device accommodating apparatus for accommodating plural developing devices which are selectively fed into the main assembly, wherein when some of the developing devices are to be transported into the main assembly, the order of transportation of the developing devices is determined on the basis of the current positions of the developing devices detected by detection means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 9, 9-1 and 9-2 are a flow chart illustrating an operation of the apparatus of FIG. 1.

FIGS. 18-1 through 18-9 are flow charts illustrating an operation for selecting a developing device.

DETAILED DESCRIPTION OF THE PREFERRED EMBODIMENT

Figure 1:
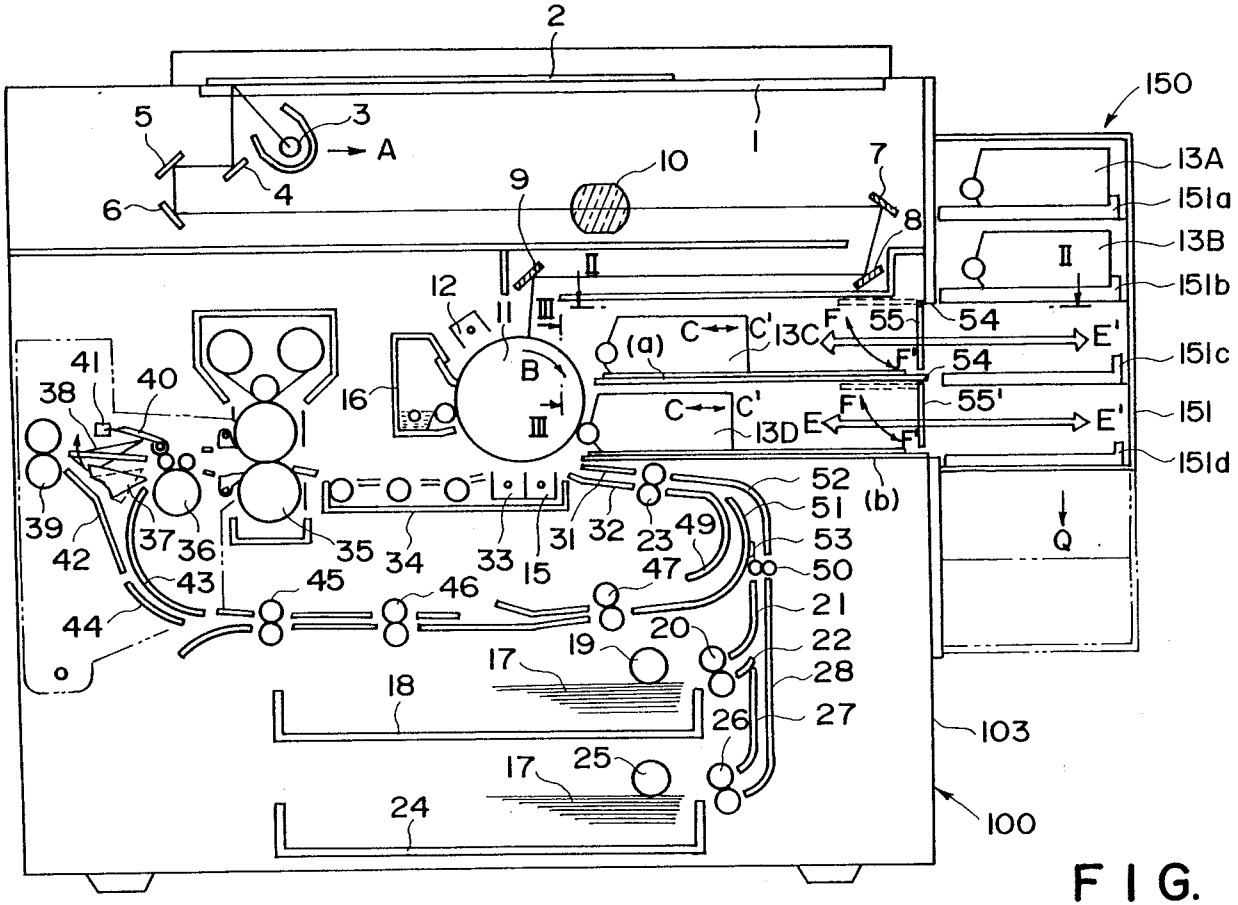
FIG. 1 is a sectional view of an image forming apparatus according to an embodiment of the present invention.

Referring to FIG. 1, there is shown an exemplary image forming apparatus as an electrophotographic copying apparatus, which is provided with plural developing stations with respect to a latent image bearing member which is an electrophotographic photosensitive member in this embodiment. The developing devices in both of the developing stations can be exchanged using a transportation passage. The developing devices not set in the main assembly of the apparatus are accommodated in an accommodating apparatus. The exemplary image forming apparatus is capable of forming a duplex copy and a superimposed copy.

An original 2 to be copied is placed on an original supporting platen glass 1. The original 2 is illuminated by a lamp 3, and a light image formed by the illumination is applied to a photosensitive member or drum in this embodiment 11 (image bearing member) through an optical system constituted by reflecting mirrors 4, 5, 6, 7, 8 and 9 and a zoom lens 10. The lamp 3 and mirrors 4, 5 and 6 travel in a direction indicated by an arrow A at predetermined speeds to sca the original 2. On the other hand, the photosensitive drum 11 is uniformly charged by a charger 12 while rotating in a direction indicated by an arrow B. Therefore, by the application of the image light to the photosensitive drum 11, an electrostatic latent image is formed on the external surface of the photosensitive drum 11 in accordance with the original image. Around the photosensitive drum 11, there is disposed a green developing device 13C containing a green developer and a red developing device 13D containing a red developer. The green developing device 13C and the red developing device 13D are movable in the direction indicated by arrows C and C', respectively. They are movable toward the photosensitive drum 11 when the color thereof is desired to be used to develop the latent image on the photosensitive drum 11. In the state shown in this Figure, the green developing device 13C is away from the photosensitive drum 11 and the red developing device 13D is close to the photosensitive drum 11, so that when the apparatus is operated, a red image is formed. The toner image formed is transferred onto a transfer material 17 (transfer sheet) by a transfer charger 15. The surface of the photosensitive drum 11 from which the image has been transferred is cleaned by a cleaning device 16 by which the residual developer is removed from the surface, so that the photosensitive drum 11 is prepared for the nex image forming operation.

The transfer material 17 is supplied in the following manner to receive an image thereon. The transfer material 17 can be supplied in two ways to an image forming station mainly constituted by the photosensitive drum 11. In the first way, the transfer material 17 is fed out of a cassette 18 by a pick-up roller 19 to a roller couple 20. The roller couple 20 is effective, when two or more transfer materials are inadvertently fed out of the cassette 18, to separate only one of them out to feed it to the image forming station. The transfer material 17 after passing through the roller couple 20, is transported to a registration roller couple through guiding plates 21, 22 and 28, a feeding roller couple 50 and guiding plates 51, 52 and 53. In the second way, the transfer material 17 is fed out of a cassette 24 by a pick-up roller to a roller couple 26. The roller couple 26 has the same function as the roller couple 20 described above. The transfer material 17 is transported, after passing through the roller couple 26, to the registration roller 23 through guiding plates 27, 28 and 21 a feeding roller couple 50 and guiding plates 51, 52 and 53. The registration roller 23 starts to rotate at the timing to align the transfer material 17 with the developed image on the photosensitive drum 11 to feed the transfer material 17 to the external surface of the photosensitive drum 11 through upper and lower transfer guides 31 and 32. As described hereinbefore, the transfer material 17 receives the toner image from the photosensitive drum 11 by the transfer charger 15, and then is separated from the photosensitive drum 11 by a separation charger 33, and subsequently is transported through a passage 34 to an image fixing device 35 having a heating roller and a pressing roller, where the image is fixed on the transfer material 17 as a permanent image. Then, the transfer material 17 is conveyed to a first discharging roller couple 36, and thereafter, is transported through flappers 37 and 38 to a second discharging roller couple 39, by which the transfer material 17 is discharged outside the apparatus. In the state shown in this Figure, the flapper 38 blocks the transfer material 17 passage but the flapper 38 is made of light material so that it is easily flexible in a direction indicated by an arrow D, and therefore, it is raised by the leading edge of the transfer material 17 when it passes, thus not obstructing the passage of the transfer material 17.

The flow of the transfer material 17 will be described in a duplex image formation mode and in a superimposing image formation mode.

When the duplex mode is selected in the main assembly of the copying machine, the apparatus is operated in the same manner described above, that is, in the simplex mode so that a fixed image is formed on one (first) side of the transfer material 17, which is then conveyed to the second discharge roller 39. The trailing edge of the transfer material 17 is detected by a transfer material detecting mechanism including a detecting lever 40 and a photosensor 41. After a predetermined period elapses therefrom (the period required for the trailing edge of the transfer material 17 pass by the flapper 38), the second discharge roller 39 starts to rotate reversely to refeed the transfer material 17 into the apparatus. By this, the transfer material 17 is transported, with the previously trailing edge leading, through the flapper 38, a left side inclined surface of the flapper 37, the guiding plate 42, and the guiding plates 43 an whereby the transfer material 17 is inversed in its orientation so that the transfer material 17 is transported to the rolle 45 with the second side facing up. The transfer material 17 reaches a lateral registration roller couple 47 through a roller couple 46. At this instance, the registration roller 47 is at rest. When the leading edge of the transfer material 17 completely abuts the nip formed between the rollers 47, the roller couples 45 and 46 also stop. In this state, the transfer material 17 waits for the image forming operation to be instructed for the second side. When an image formation starting signal is produced for the second side, the registration roller 47 starts to rotate to transport the transfer material 17 to the registration roller 23 through the guiding plates 49 and 51. Before the transfer material 17 reaches the registration roller couple 23, a lateral edge of the transfer material 17 is detected by an unshown photosensor, and the lateral registration roller 47 shifts in its longitudinal direction, that is, perpendicular to the direction of the transportation of the transfer material 17, namely, perpendicular to the sheet of the drawing to align the lateral edge with the first image formation. The operation after the transfer material 17 reaches the registration roller 23 is the same as the simplex copy operation, and the transfer material 17 on which the image is formed on the second side is finally discharged by the second discharging roller 39.

When the superimposing mode is selected, the operation for the first side image formation is the same as with the simplex copy operation. After the first side image formation, the flapper 37 takes the position indicated by broken lines, so that the transfer material 17 is transported with its previously leading edge leading, by the first discharging roller 36 along the right side inclined surface of the flapper 37 to guides 42 and 43, and further to the roller couple 45 through the guides 43 and 44. The tranfer material 17 reaches the registration roller 47 through the roller couple 46. The trailing edge of the transfer material 17 is detected by the detecting lever 40 and the photosensor 41. After a predetermined period elapses therefrom, the flapper 37 restores its solid line position. When a signal for starting the second side image formation, the registration roller 47 starts to rotate. The movement of the transfer material 17 at this time is the same as in the duplex mode. The transfer material 17 now having the second image is discharged by the discharging roller 39 to a tray outside the apparatus. In the foregoing, the image formation for superimposing two images are explained, but a larger number of images can be superimposed through fundamentally the same process, with the exception that the flapper 37 is switched from the broken line position to the solid line position after the final image formation.

The description will now be made as to a developing device accommodating apparatus 150 attached to an outside of the main assembly 100 of the copying apparatus.

The developing device accommodating apparatus, which will hereinafter be called also "accommodating apparatus", is responsive to a selection signal which can be operated by an unshown selector means to feed or supply the selected one of the developing devices into 100.

The accommodating apparatus 150 includes an accommodating case 151 provided with partition stages 151*a*, 151*b*, 151*c* and 151*d*, which support a sepia developing device 13A containing a sepia developer, a blue developing device 13B containing a blue developer, a green developing device 13C containing a green developer and a red developing device 13D containing a red developer, for example, respectively. Those developing devices are selectively movable into the main assembly 100. In the state shown in the Figure, the green developing device 13C and 13D are not contained in the accommodating case 151, but are placed adjacent the photosensitive drum 11 in the main assembly 100 to be prepared for a developing operation to develop the latent image thereon. The transportation of the green developing device 13C and the red developing device 13D is performed in the manner which will be described, using a developing device transportation means X for moving between E and E' in FIGS. 2–4. The developing device in the accommodating case 151 is introduced into the main assembly 100 through shutters (inlet) 55 and 55' provided at the main assembly 100 side. Each of the shutter 55 and the shutter 55' is mounted on the main assembly 100 for rotation about a shutter shaft 54 in a direction indicated by F or F'. When a developing device is to be introduced into the main assembly 100, it is opened by a solenoid or the like so as not to obstruct the introduction, as shown by broken lines.

Figure 5:
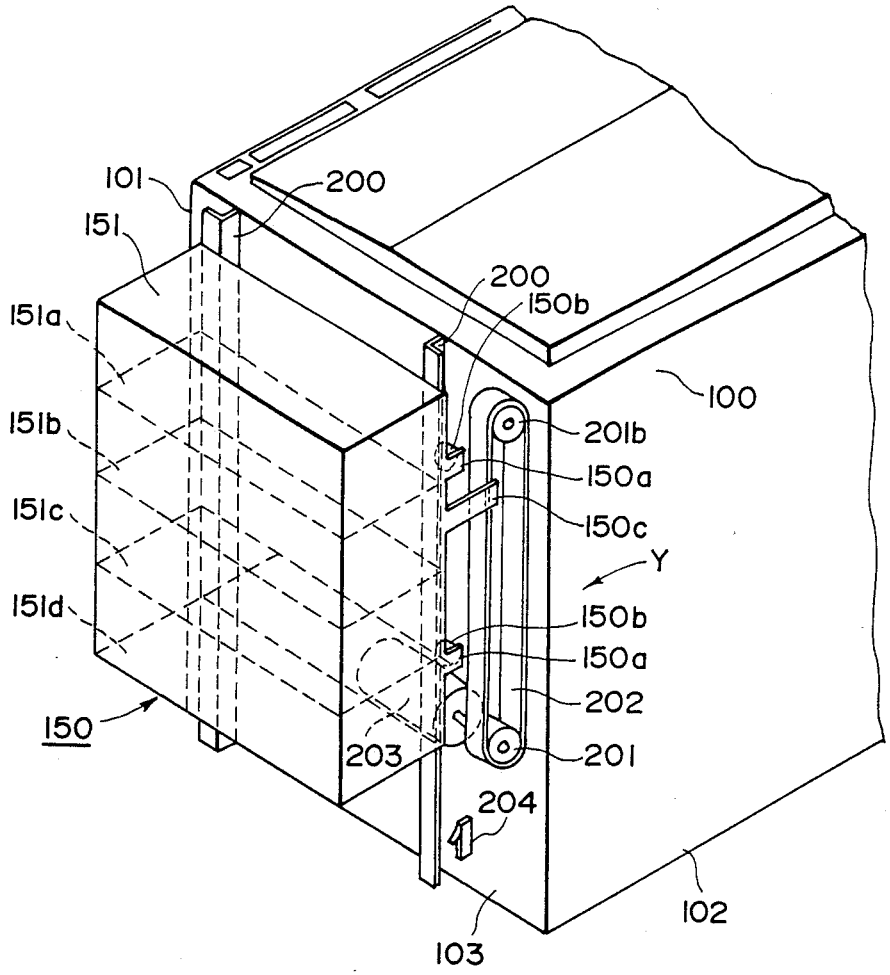
FIG. 5 is a perspective view illustrating means for moving an accommodating case.

The accommodating apparatus 150 is further provided with a case moving means Y as shown in FIG. 5, which will be described in detail hereinafter. The case moving means Y is effective to move the accommodating case 151 substantially in the vertical direction relative to the main assembly 100, as shown by chain lines, by which the partition stage 151*a*, 151*b*, 151*c* or 151*d* supporting a desired developing device is placed opposed to the inlet to the main assembly 100 formed by the shutter 55 or 55' to make the desired one transportable into the main assembly 100. In the example shown in this Figure, the partition stages 151*c* and 151*d* are aligned therewith.

Figure 6:
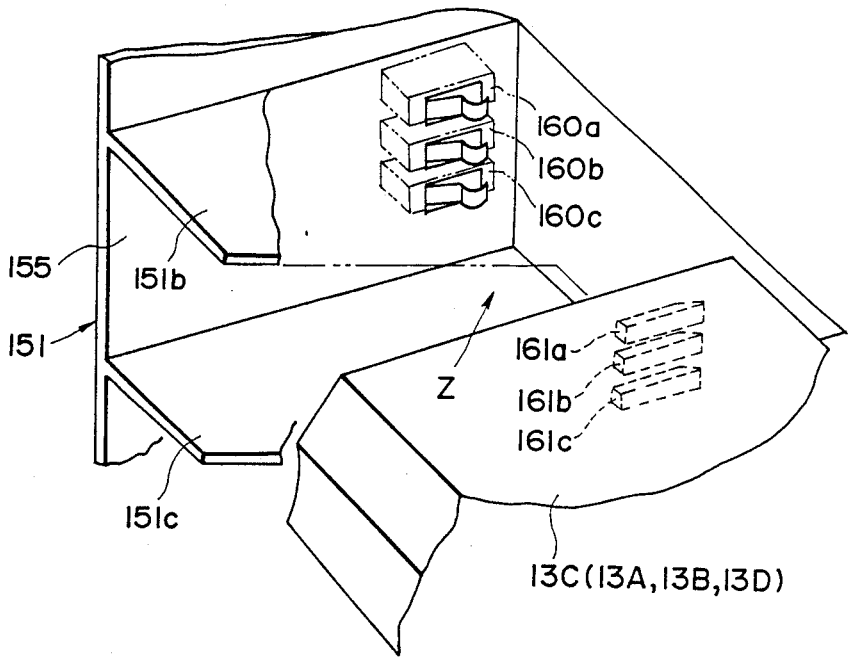
FIG. 6 is a perspective view illustrating means for discriminating the color of the developer contained in a developing device.

For the purpose of description, it is assumed that the main assembly 100 selects the sepia developing device 13A. First, the green developing device 13C is returned to the partition stage 151*c* of the accommodating case 151 by the developing device transportation means X shown in FIGS. 2–4. During this returning operation, the shutter 55 is retracted to the open position shown by the broken lines. When the green developing device 13C is returned into the accommodating case 151, the presence of the green developing device 13C in the accommodating case 151 is confirmed by a color discriminating means shown in FIG. 6. When the presence of the green developing device 13C is confirmed, the case moving means Y shown in FIG. 5 starts to move the accommodating case 151 vertically, more particularly, downwardly in this case and stops it when the partition stage 151*a* supporting the sepia developing device 13A is brought to be in alignment with the inlet (shutter 55) of the main assembly 100. Then the sepia deceloping device 13A is transported to the neighborhood of the photosensitive drum 11 by the developing device transportation means X shown in FIGS. 2–6 and is now prepared for developing the latent image on the photosensitive drum 11. The operation is the same as this case, when another color developing device is selected.

Figure 2:
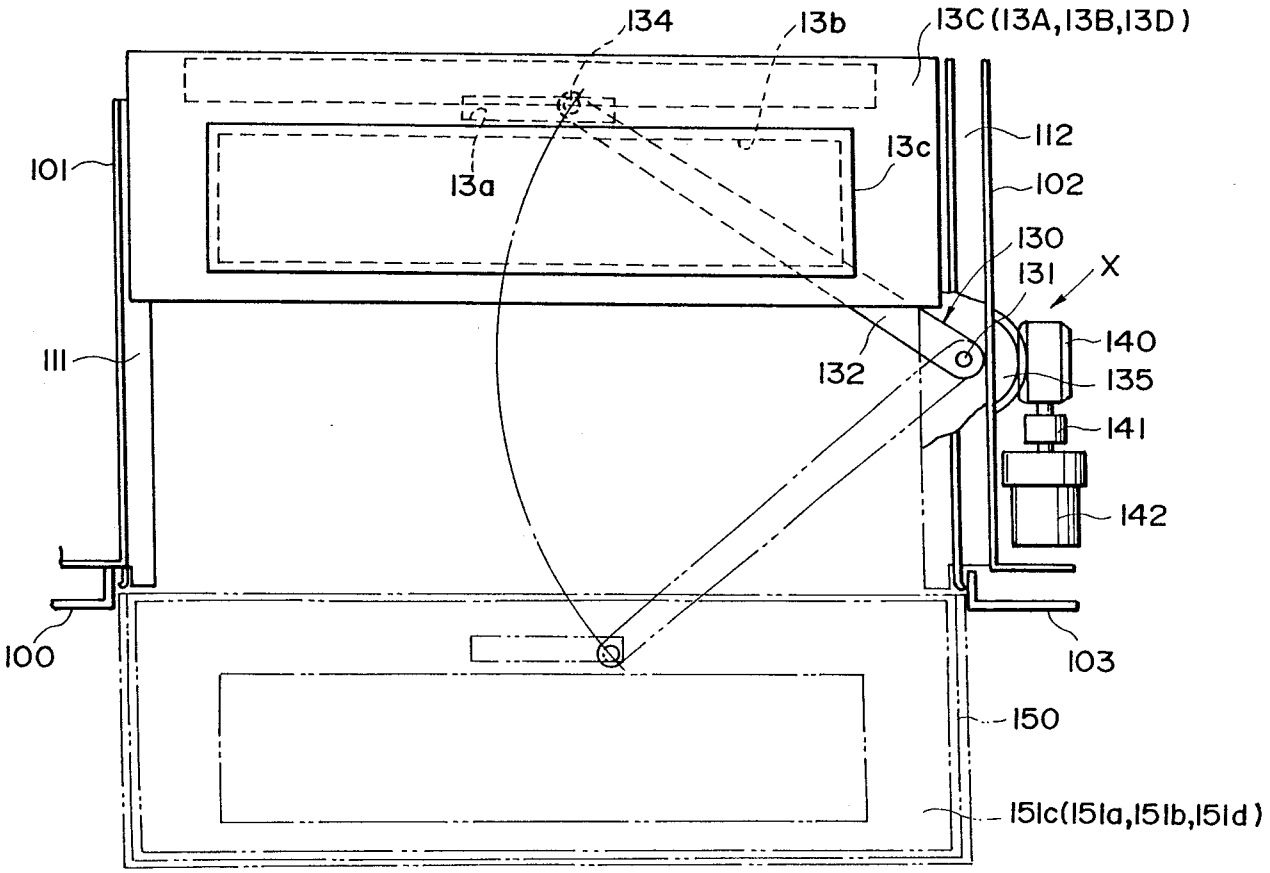
FIG. 2 is a sectional view taken along line II—II of FIG. 1.
Figure 3:
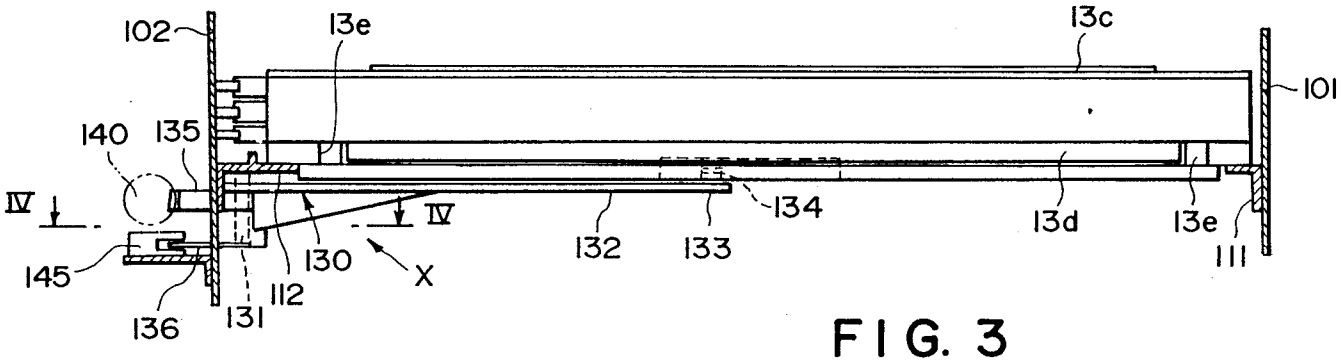
FIG. 3 is a sectional view taken along line III—III of FIG. 1.
Figure 4:
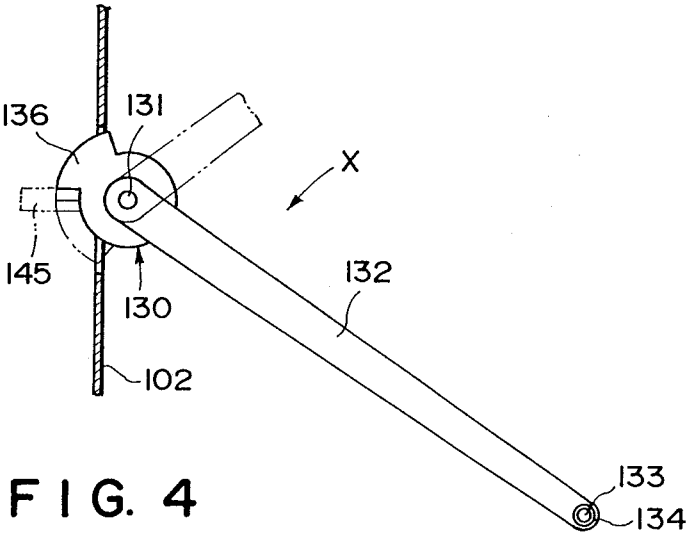
FIG. 4 is a sectional view taken along line IV-IV of FIG. 1.

Referring to FIGS. 2–4, there is shown the developing device transportation means X for feeding a desired color developing device in the accommodating case 151 to the neighborhood of the photosensitive drum 11 in the main assembly 100 through a first developing device loading table a. FIGS. 2, 3 and 4 are sectional views taken along lines II—II, III—III and IV—IV, respectively.

The main assembly 100 has side plates 101 and 102 on which slide guides 111 and 112 are fixedly mounted to receive the weight of the developing device and to guide it from the accommodating case 151 to the neighborhood of photosensitive drum 11. The shutter shaft 54 of the shutter 55 is fixed to the side plates at opposite ends thereof. In the state shown in FIG. 1, the shutter 55 is attracted by a magnet clutch or the like not shown to maintain the close position indicated by the solid lines. When the shutter 55 is opened as indicated by broken lines, an end portion thereof is in abutment with a stay 104 of the main assembly 100. At this time, the shutter 55 is maintained at the open position by an unshown solenoid or the like, as described above. Adjacent the position of the stay 104 where the shutter 55 abuts, an unshown microswitch is provided to detect the opening of the shutter 55.

On a bottom surface of each of the chromatic color developing devices 13A, 13B, 13C and 13D, a groove **13*a* is formed by ribs to receive a pressing roll of a driving arm which will be described hereinafter. In the top surface thereof, a developer replenishing inle opening 13*b* is formed which is normally closed by a cover 13*c*. A spacer roller 13*e* is rotatably mounted to each of the opposite end flanges of a developing sleeve 13*d* to maintain a predetermined clearance between the photosensitive drum 11** surface and the developing sleeve surface.

Below one of the slide guides 112, there is provided a driving arm 130 having a drivable range enough to transport the developing device from the accommodating case 151 to the neighborhood of the photosensitive drum 11 in the main assembly 100. The arm 130 is rotatable about a shaft 131 mounted normally to the slide guide 112, and it includes an arm 132 extending toward the developing device side. To an end of the arm 132, a pin 133 is mounted to rotatably support a pressing roll 134 which is engageable with the groove **13*a* of the developing device. To the other end of the arm 132, a worm wheel gear (sector gear) 135 is fixedly mounted, which is rotatable about a shaft 131. The gear 135 is exposed through an opening of a side plate 102. The gear 135 is in meshing engagement with a worm gear 140 mounted to the main assembly 100 outside the side plate 102. The gear 140 is coupled with a reversible DC motor 142 through a torque limiter 141. Outside the side plate 102, there is provided a photointerruptor 145 for detecting the amount of rotation of the arm 132, which detects the position of the arm 132 by detecting a slot of a disk 136 formed at a portion of the driving arm 130**.

The operation of the arm 130 will be described. When the main assembly 100 is instructed to return the green developing device 13C and to introduce the sepia developing device 13A, the motor 142 is released from,its locking. By this, a screw of the torque limiter 141 which has been spring-charged is eased to release the green developing device 13C from the urging force to the photosensitive drum 11. Then, the motor 142 starts to rotate reversely to move the green developing device 13C in the direction E' by the pressing roll 134 at an end of the arm 132 pressing the wall of the groove **13*a* of the bottom surface of the green developing device 13C. During this action, the arm 132 swings. When the end thereof reaches the then opened shutter 55, the photointerruptor 145 detects the slot of the disk 136. When a predetermined period elapses thereafter, the motor 142 is stopped. Through such an operation, the green developing device 13C is collected back into the partition stage 151*c* of the accommodating case 151. After this, the color discriminating means Z discriminates the presence of the green developing device 13C in the accommodating case 151**.

Subsequently, the accommodating case 151 starts to move downwardly by the case moving means Y shown in FIG. 5 which will be described hereinafter, and it is stopped when the partition stage **151*a* supporting the desired developing device 13A is brought into alignment with the inlet of the main assembly 100. Then, the motor 142 starts to rotate in the forward direction, by which the arm 132 starts to rotate, and the sepia developing device 13A is urged by the pressing roll 134 to start it to move in the direction E. Through the opened shutter 55, it is introduced into the main assembly 100. With further rotation of the arm 132, the pressing roll 134 reaches the photosensitive drum 11 side end of its movable range, and then, the slot of the disk 136 actuates the photointerruptor 145 to inform a control means of the main assembly 100 of the arrival of the sepia developing device 13A. The motor 142 is continued to rotate for a predetermined period from this point of time, by which a pressing force is charged in the spring of the torque limiter 141, so that a pressing force is applied to the pressing roll 134 provided at the end of the arm 132. By this, the sepia developing device 13A is urged to the photosensitive drum 11 so that the spacer rollers 13*e* are brought into contact with the photosensitive drum 11**, the spacer roller being coaxial with the developing sleeve.

Although not shown in the Figure for the sake of simplicity, another developing device transportation means is provided for a second developing device loading table b, said another developing device transportation means having the same structure as the first transportation means X.

Referring to FIG. 5, the case moving means Y will be described in detail.

A couple of rails 200 are mounted on a rear plate 103 of the main assembly 100, and the rails 200 vertically extend in parallel with each other. The accommodating case 151 is vertically movably engaged with the rails 200, more particularly, the accommodating case 151 is engaged with the rail 200 by guides **150*a* mounted at top and bottom positions at both sides. Each of the guides 150*a* is provided with rollers 150*b* to reduce the friction with the rail 200. The roller 150*b* is in rolling contact with the inside of the rail 200. On the rear plate 103, a driving pulley 201*a* and a follower pulley 201*b* are mounted to function as a driving means. A belt 202 is trained around the pulleys with a predetermined tension. To a part of the belt 202, an arm 150*c* is fixed which is integral with the accommodating case 151. A reversible motor 203 in the form of a pulse motor is coupled to the rotational shaft of the lower driving pulley 201*a*. By rotation of the motor 203, the accommodating case 151 moves vertically alon the rails 200 relative to the main assembly 100. There is provided a microswitch 204 at the accommodating case 151 side such that when the sepia developing device 13A accommodated on the top partition stage is brought into alignment with the inlet opening of the main assembly 100, a part of the accommodating case 151 strikes a lever of the microswitch 204**.

As to the time when the case moving means Y is operated, the description will be omitted here, since it has been made with respect to the developing device transportation means X. The motor 203 starts to operate in response to the instructions from the main assembly 100, to rotate in a predetermined direction and through a predetermined amount, and then stops. The direction and the amount are determined on the basis of the current position of the desired developing device relative to the inlet to the main assembly 100.

In this embodiment, the driving system includes a driving pulley, a follower pulley and a belt, but may be of the type using a rack-pinion mechanism or of the type using a linear motor.

The case moving means Y also operates when the developing device in the main assembly 100 is returned to the accommodating case 151 by the arm 130, in order to release the pressing roll 134 of the arm 132 from the groove 13*a* of the developing device side. More particularly, at the instance when the developing device is returned to the accommodating case 151, the pressing roller 134 is still in engagement with the groove 13*a*, so that the arm 132 is able to retract to such a position not interfering with the vertical movement of the accommodating case 151. In order to enable the retraction of the arm 132 to release the pressing roll 134 from the groove 13*a*, the case moving means Y operates for slight amount movement after the developing device is received by the accommodating case 151 by the discriminating means Z. More particularly, the motor 203 operates through a slight amount, to lift the accommodating case 151 by an amount corresponding to the width of the pressing roll 134. By doing so, the arm 132 is able to be retracted to a position not interfering with the vertical movement of the accommodating case 151. Thereafter, the case moving means Y operates in an usual manner to lift or lower the accommodating case 151.

In this embodiment, the engagement between the pressing roll 134 and the groove 13a of the developing device is released by moving the accommodating case 151 upwardly by the case moving means Y. However, another method is possible, for example, the rib constituting the groove 13a is made swingable, and the rib is swung when the developing device is returned into the accommodating case 151, so that the arm 132 is retracted to the position not interfering with the vertical movemen of the accommodating case 151.

The description will be made as to the discriminating means for discriminating the color of the developer contained in the developing device returned into the accommodating cas 151 from the main assembly 100.

The color discriminating means Z is constituted by a color detection switch (microswitch) provided in the accommodating case 151 side and a color detecting projection provided in the color developing device side. Three color detection switches 160*a*, 160*b* and 160*c* are mounted in a line on a rear wall 155 of a developing device accommodating portion constituted by each of the partition stages 151*a*–151*d*. Correspondingly, a rear wall of each of the developing devices 13A, 13B, 13C and 13D is provided with projections 161*a*, 161*b* and 161*c* which are able to actuate switch levers of the color detecting switches 160*a*, 160*b* and 160*c*, respectively, when the developing devices are received by the accommodating case 151 in place. Therefore, when the developing device is accommodated in the accommodating case 151, the projections actuate the switches, and in response to the signal of the actuations, the color of the developing device is discriminated.

In this example, the color of the developing device and the absence thereof can be detected in the following manner. The detection switches 160*a*, 160*b* and 160*c* produce signals S1, S2 and S3 which are "0" when the corresponding switch is off and "1" when the corresponding switch is on. If all the signals are "0", it represents the absence of the developing device. If the signals S1, S2 and S3 are 1, 0 and 0, it represents sepia color; 0, 1 and 0 represents blue color, for example. The projections 161*a*, 161*b* and 161*c* are so designed as to satisfy the above.

In this example, the color discrimination and the developing device absence discrimination are effected using the three color detection switches and the three projections for actuating the switches. However, the number of the elements is not limited to this. Also, photointerruptors may be used in place of the microswitches. Any other means are usable, if it discriminates the color and the absence of the developing device.

In this example, the color discrimination is used to descriminate whether the predetermined color developing device is received by the accommodating case 151, another method is possible if it can discriminate the color of the developing device.

The description will be made as to an operation for a superimposed multi-color image.

As shown in FIG. 1, the gren developing device 13C and the red developing device 13D are placed on the first developing device loading table and on the second one, respectively. Of these developing devices, the red developing device 13D is urged to the photosensitive drum 11 by the arm 132 of the developing device transportation means X. Therefore, if the apparatus is operated in this state, a red image is produced.

Figure 7:
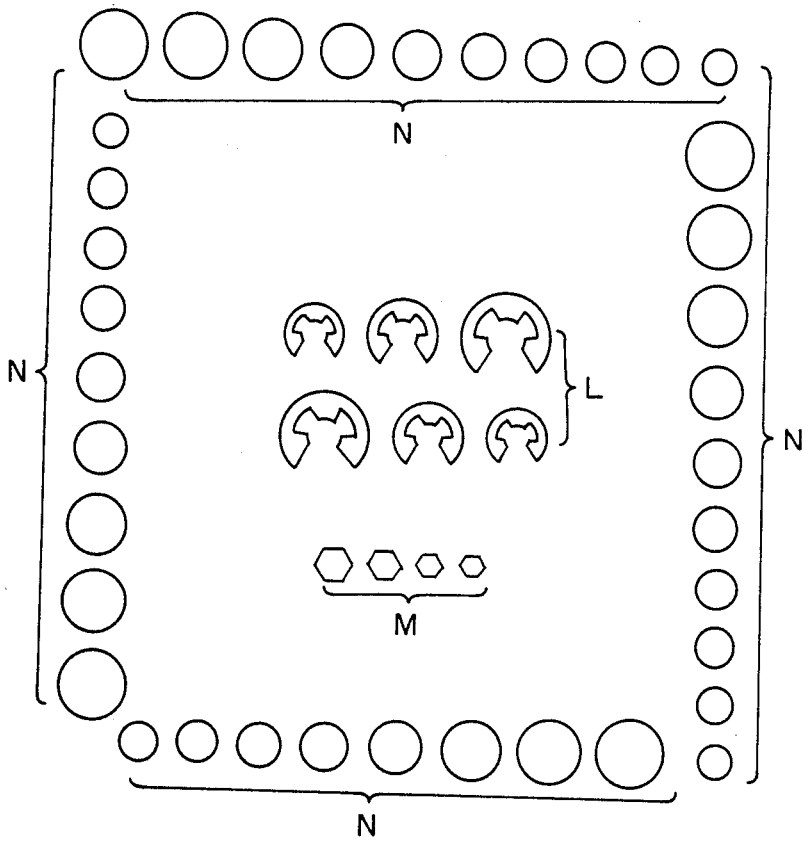
FIG. 7 is a plan view of an original to be copied.

Referring to FIG. 7, an original shown in this Figure is desired to be copied in green in the areas indicated by references L and M and in red in the areas indicated by reference N. The operator inputs L and M regions by a known area selector (not shown) and starts the copy operation. Then, the first copy operation is effected for the area N using the green developing device 13C placed nearer to the photosensitive drum 11. The copying process has been described hereinbefore. The second copy operation is effected for the areas L and M in green color. When the copy operation is started, after the area is selected in the similar manner as red in the regions L and M and as green in the region N with the same setting of the developing devices, the first copying operation is effected for the areas L and M using the green developing device 13C which is closer to the photosensitive drum 11, and then N region is copied in green.

In this embodiment, as will be understood from the foregoing, the superimposing and multi-color operation starts with the color of the developing device which is set operable in the developing position irrespective of the designation of the regions. In this embodiment, the end of the passage of the transfer material 17 detected by the photosensor 41 of the detecting lever 40 represents the completion of the first copy operation. Therefore, the red developing device 13D is released from the urging force toward the photosensitive drum 11, and the green developing device 13C is urged to the photosensitive drum 11 to be prepared for the second copy operation.

The description will be made as to the case where the regions L and M are to be copied in green whereas the region N is to be copied in sepia by developing device 13A which is now contained in the accommodating apparatus 150.

Before describing the operation in this case, each of the developing devices 13A, 13B, 13C and 13D has projections 301*a*, 301*b*, 301*c* and 301*d* at the rear plate 102 thereof. Correspondingly, to the side of each of the first loading table a and the second loading table b, microswitches 300*a*, 300*b*, 300*c* and 300*d* are mounted in association with the projections 301*a*, 301*b*, 301*c* and 301*d*.

When, for example, the red developing device 13D is introduced into the main assembly 100 by the second loading table b, the microswitches 300*a*, 300*b*, 300*c* and 300*d* are actuated by the projections 301*a*, 301*b*, 301*c* and 301*d*, and the combination of the signals from the switches is used to discriminate the color of the developer contained in the developing device. The method of color discrimination is the same as the color discriminating using the discrimination means Z in the accommodating apparatus 150. When the red developing device 13D is urged toward the photosensitive drum 11, the projection 301*a* abuts and actuates the microswitch 300*a*, by which the event is detected that the red developing device 13D is urged and placed in the operative state. In this manner, the color of the developer contained in the developing device placed in the main assembly 100, and that of the one in the operative position can be detected.

Figure 8:
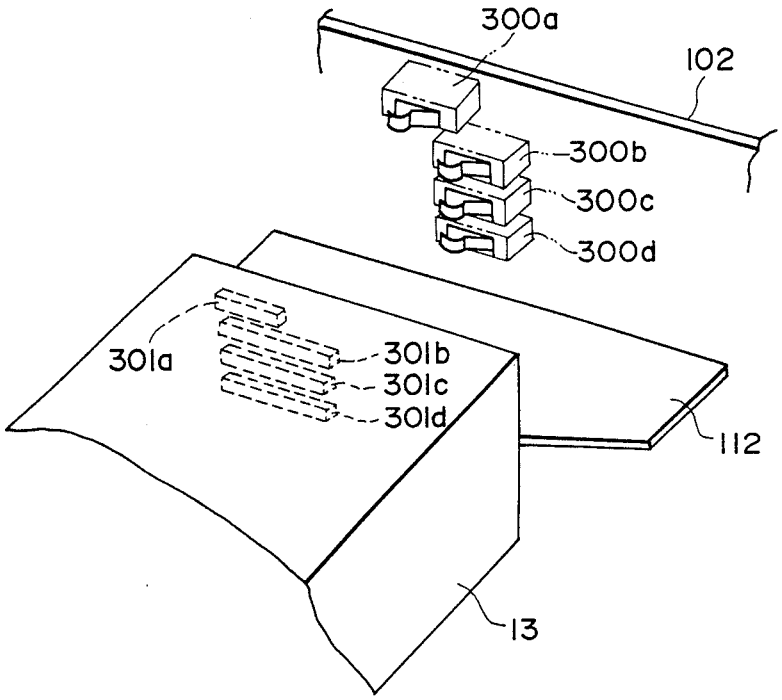
FIG. 8 is a perspective view showing press detecting means and color detecting means in the accommodating apparatus.

When the color designation is such that the regions L and M are copied in green and the region N in sepia, and the copy operation starts, the red developing device 13D on the second loading table b is immediately released from the urging, since the red is not the selected color. And, the red developing device 13D is returned t the accommodating apparatus 150 by the developing device transportation means X. Simultaneously, the green developing device 13C containing the green developer is urged to the photosensitive drum 11 since green is selected. When the urging is confirmed by the means described in conjunction with FIG. 8, the pick-up roller 19 is driven to start the image forming operation for the first copy. On the other hand, upon the color discriminating means shown in FIG. 6 detecting that the red developing device 13D is accommodated in the accommodating apparatus 150, the accomodating apparatus 150 is lowered by the case moving means Y in the direction F by the amount corresponding to two stages, whereby the sepia developing device 13A is set in alignment with the inlet to the first loading table, and thereafter, the sepia developing device 13A is fed into the main assembly 100 by the developing device transportation means X. When the completion of the first copy operation is detected by the lever 40 and the sensor 41, the sepia developing device 13A is urged to the photosensitive drum 11, and the second copy operation is performed.

As described in the foregoing, according to this embodiment, the control is effected to determine the order of the operation, that the image forming operation starts with the developing device placed at the time in the operative position irrespective of the color designation of the region, in order to save the time period required for the automatic exchange of the developing devices. Additionally, the color developing device for the second image forming operation is set into the main assembly 100 during the first image forming operation being performed. Therefore, the color or superimposing operation can be effected more easily and speedily than in a conventional system wherein the multi-color superimposing image formation is performed with manual exchange of the developing devices, and than in a conventional system wherein when, for example, the regions L and M of FIG. 7 are to be copied in red and the region N to be copied in black, the inside areas L and M are first copied and only then the outside area N is copied all irrespective of which developing device is in the developing position at the time, as in a conventional type wherein two color developing devices are built in the apparatus.

The foregoing description has been made with respect to the case where the two color images are superimposed, but the present invention is also applicable to three, four or more color images superimposed. Also, the present invention is applicable to the case where there are two or more developing portions.

As described in the foregoing, according to this embodiment of the present invention, the image forming operation starts with the developing device located close to the photosensitive drum 11 at the time, and the developing d to be used next is set into the developing position next, and therefore, the multi-color superimposing copy can be performed without difficulty and with high total speed.

Figures 1, 9:
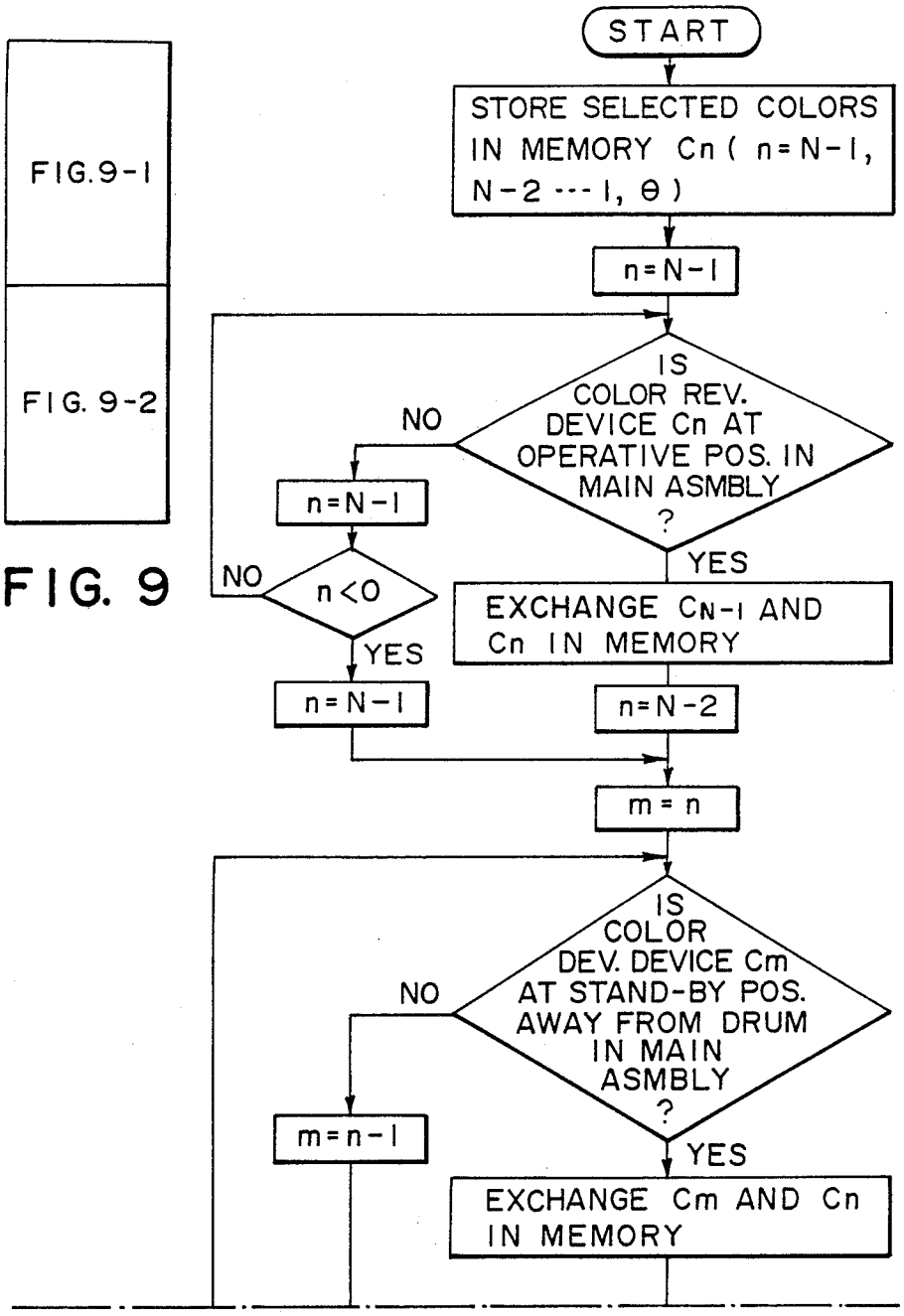
Figures 2, 9:
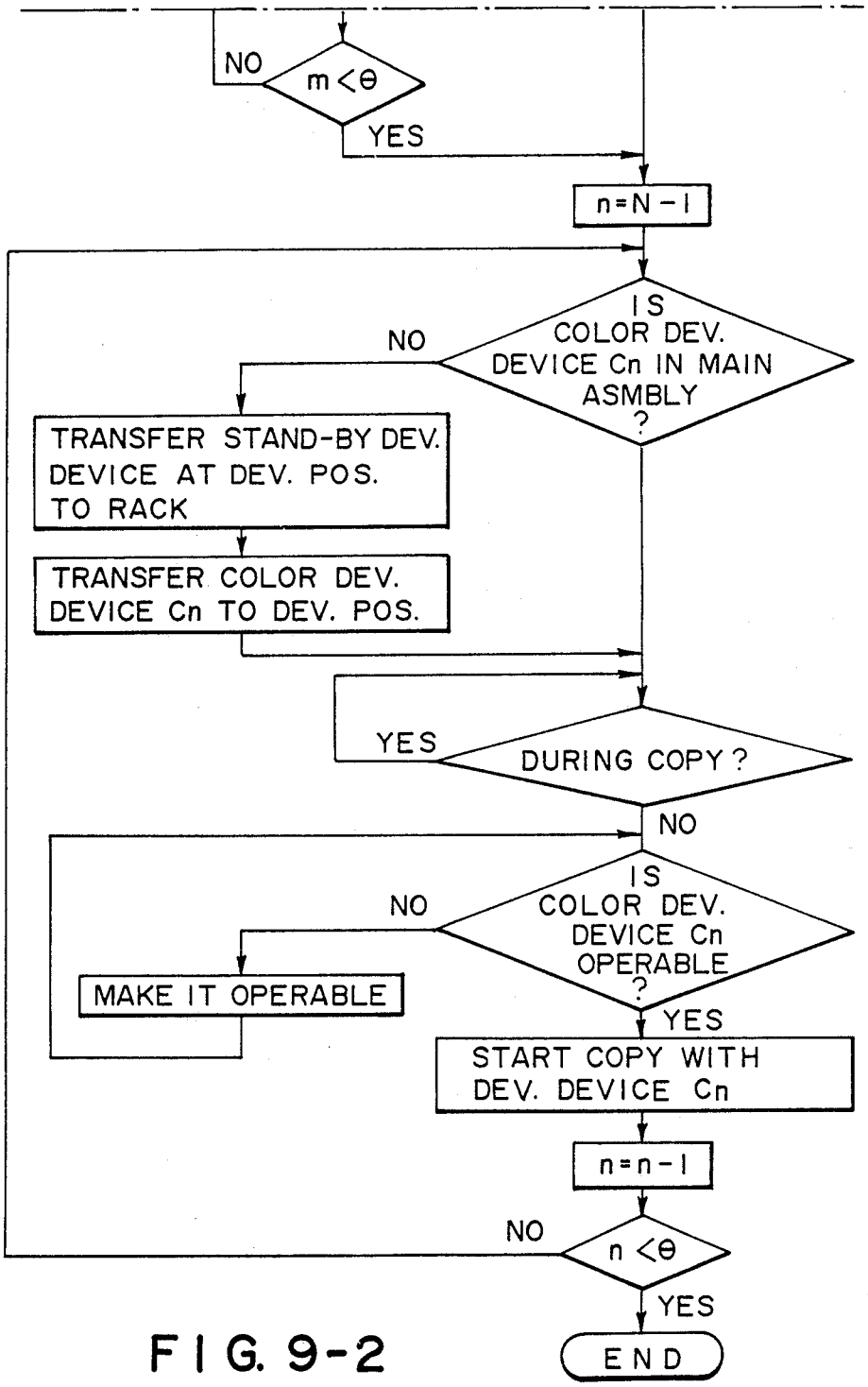

Referring to FIG. 9 which is a flow chart, the control of the apparatus according to this embodiment will be described. In this sequence, the discrimination is made as to whether one or two of the selected color developing devices are in the one or two of the passages or not, and if so, the image forming operation starts with the developing device in the passage.

At step 91, the colors are selected. Then, the discrimination is made as to whether or not one of the selected color developing device is in the condition ready for operation at step 92. At step 93, the discrimination is made as to whether or not the other selected color is the color of the developer contained in the developing device in the other passage in the stand-by state. If the selected developing device or developing devices are present there, the image forming operation starts with it or them, irrespective of the order of the selection of the colors, step 94–step 95.

In this manner, the image forming operation starts with the readily available one or ones, irrespective of the order of the selection, and therefore, the total copy speed is increased since the time required for the selected developing device to be set into the main assembly 100 is minimized if it is in the accommodating apparatus 150.

Another embodiment of the present invention will be described wherein the main assembly of the image forming apparatus is provided with plural developing stations, but in only one of them the developing device is exchangeable. To the exchangeable developing station, a selected one of the developing devices accommodated in an accommodating apparatus can be introduced.

Figure 10:
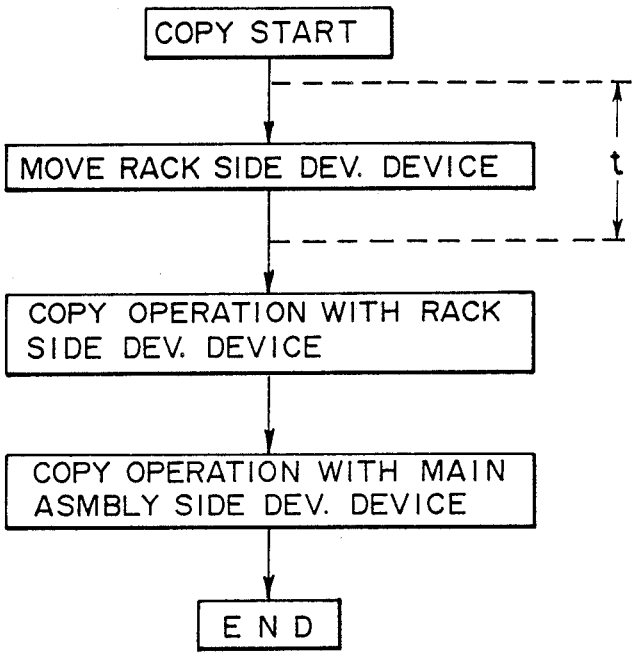
FIG. 10 is a flow chart illustrating an operation of a conventional apparatus.

It is usual in such a type of image forming apparatus that the non-exchangeable developing station has a black developing device containing a black developer, since the black developer is most frequently used. When the black color and a color of the developer contained in the developing device accommodated in the accommodating apparatus are selected, it is probable to start the image forming operation with the non-black color. However, if this is done, the start of the actual image forming operation is delayed by the time to required, for the selected non-black developing device to be introduced into the main assembly and placed to the operative position, as shown in FIG. 10.

Figure 11:
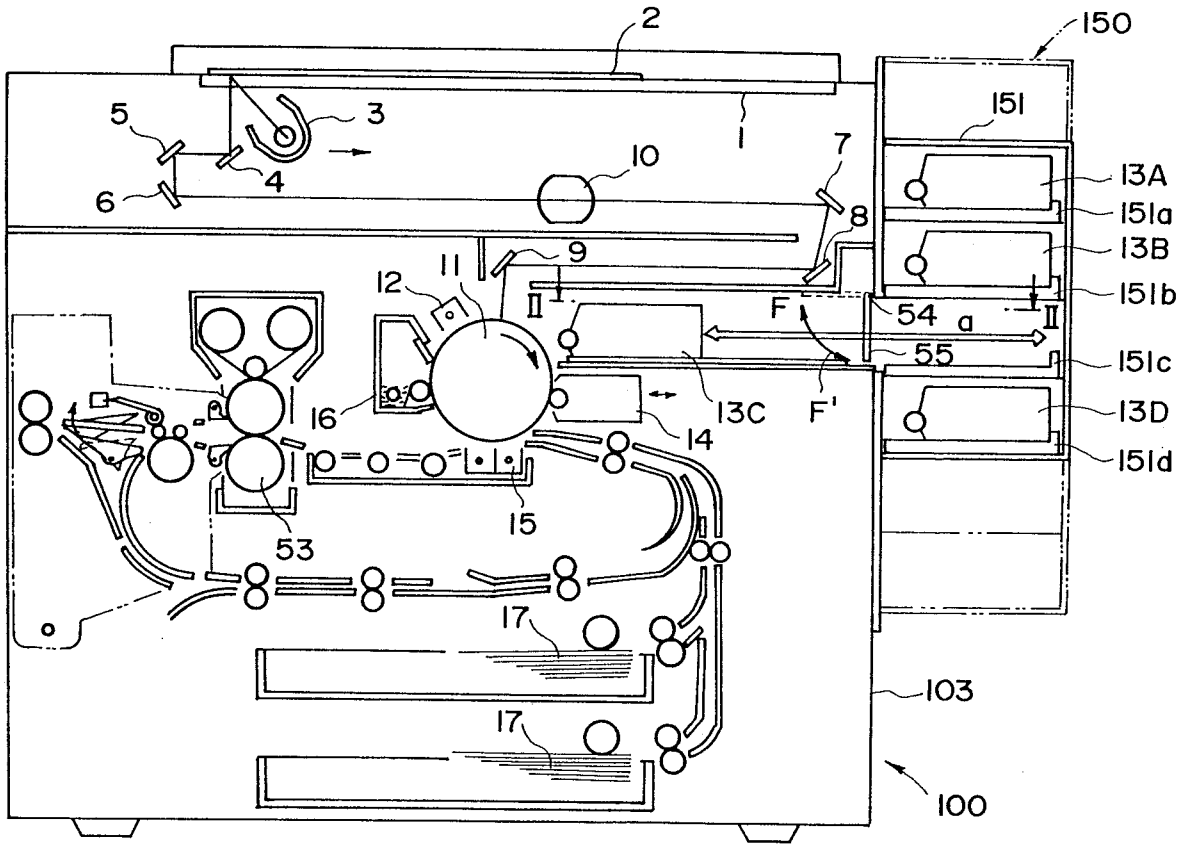
FIG. 11 is a sectional view of a copying apparatus.

Referring to FIG. 11, there is shown an image forming apparatus wherein this problem has been solved. For the sake of simplicity of explanation, the same references are assigned to the corresponding element, and the detailed explanation is omitted. In this apparatus, a black developing device 14 is stationary, in the sense that it is not readily exchangeable with other developing devices although it is slightly movable between the operative position wherein it is urged to the photosensitive drum 11 and an inoperative position wherein it is not urged to the photosensitive drum 11.

The image forming apparatus comprises a main assembly A and a developing device accommodating apparatus B which is vertically movable relative to the main assembly A.

The description will be made with respect to the accommodating apparatus B. It is provided with partition stages 151*a*, 151*b*, 151*c* and 151*d* which are for supporting the red developing device 13A, the blue developing device 13B, the green developing device 13C and the sepia developing device 13D. In the state shown in this Figure, the green developing device 13C is not in the accommodating apparatus B, but is within the main assembly A at a stand-by position adjacent the photosensitive drum 11 where it is waiting for the developing operation instruction. Also, the green developing device 13C can be transported between the developing position shown and the partition 151*c* of the accommodating apparatus B in the direction a by the transportation means shown in FIGS. 12–14.

Figure 12:
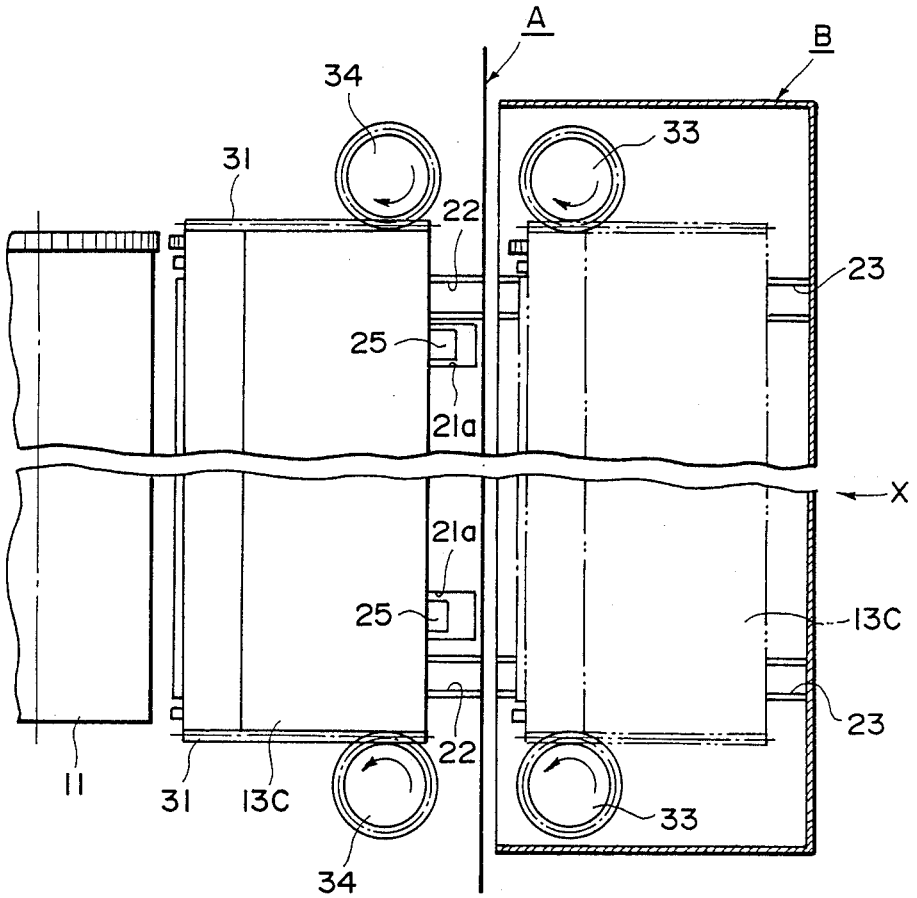
FIG. 12 is a sectional view taken along line II—II of FIG. 11.
Figure 13:
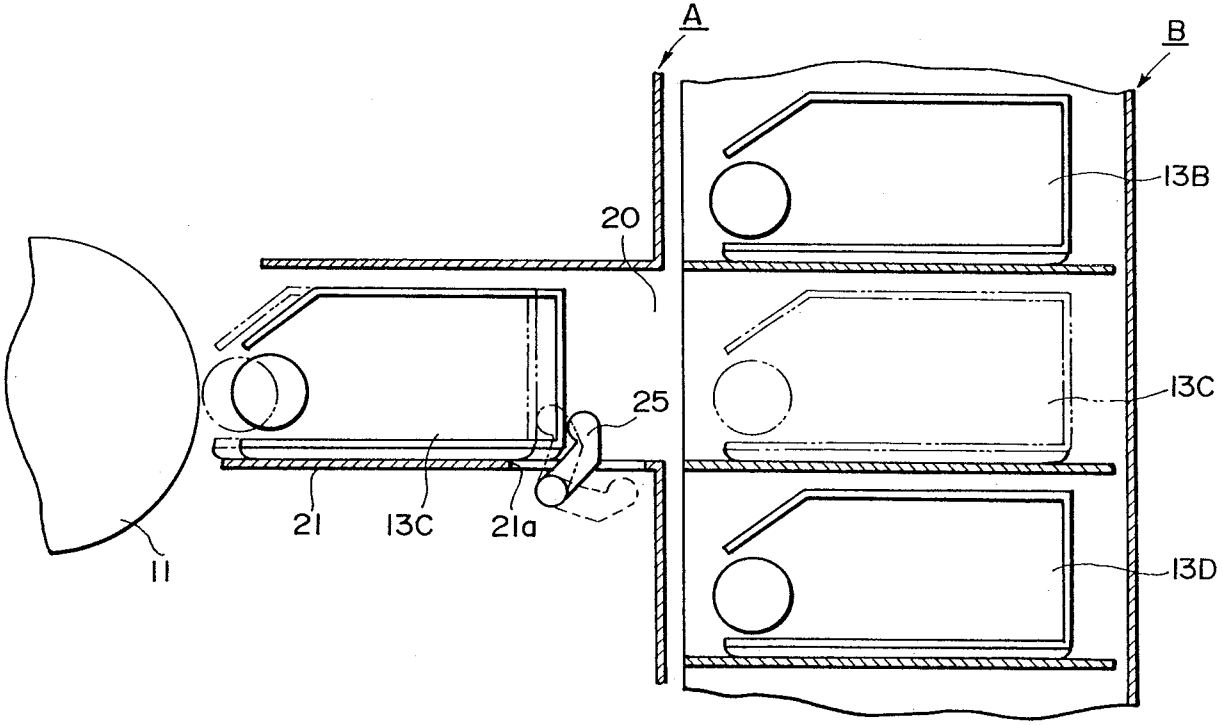
FIG. 13 is a partial sectional view illustrating the relation between a developing device accommodating apparatus and a photosensitive member of a main assembly of the copying apparatus.
Figure 14:
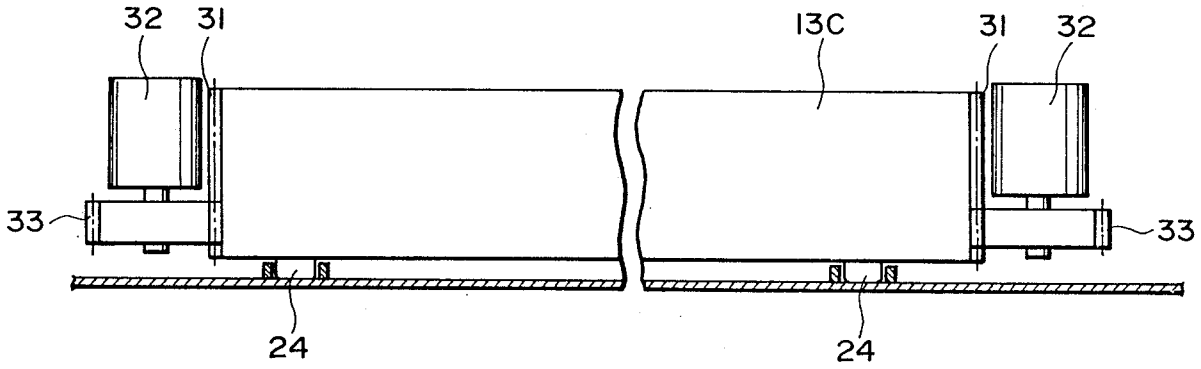
FIG. 14 is a side view seen in a direction of an arrow X in FIG. 12.

Referring to FIGS. 12–14, the description will be made as to the transportation means, wherein FIG. 12 is a sectional view taken along II—II of FIG. 11; FIG. 13 is a partial sectional view illustrating a relation between the photosensitive drum 11 and the accommodating apparatus B; and FIG. 14 is a side view seen from X in FIG. 12.

The main assembly A is provided with an opening 20 in the side opposed to the accommodating apparatus B to allow introduction of the developing device into the main assembly A. Between the opening 20 and the photosensitive drum 11, a transportation passage 21 is formed horizontally within the main assembly A. For the passage 21, guides 22 and 22 are provided parallel and with a predetermined space as shown in FIG. 12. Correspondingly, each of the partition stages 151*a*, 151*b*, 151*c* and 151*d*, is provided with similar guides 23 and 23 in the same direction and with the same spacing.

Each of the developing devices 13A, 13B, 13C and 13D has on its bottom surface guide members 24 and 24, as shown in FIG. 14, which are engaged with the guides 23 and 23 when it is in the accommodating apparatus B so that the developing device is confined in the lateral movement.

Rectangular cut-away portions 21*a* and 21*a* are formed at the inside of the guide 22 for the transportation passage 21. The cut-away portions are provided with a pressing cam 25 which is effective to push the rear side of the developing device introduced into the main assembly A from the accommodating apparatus B, so as to urge the developing device toward the photosensitive drum 11 with a predetermined pressure.

Each of the developing devices 13A, 13B, 13C and 13D is provided with racks 31 and 31 on both of the side surfaces, as shown in FIGS. 12 and 14. When the developing device is in the accommodating apparatus B, the racks 31 and 31 are in meshing engagement with gears 33 and 33 which are coupled with reversible DC motors 32 and 32 in the accommodating apparatus B. When the developing device is in the transportation passag 21 in the main assembly A, the racks 31 and 31 are in meshing engagement with gears 34 and 34 which are coupled with an unshown DC motor in the main assembly A.

Figure 15:
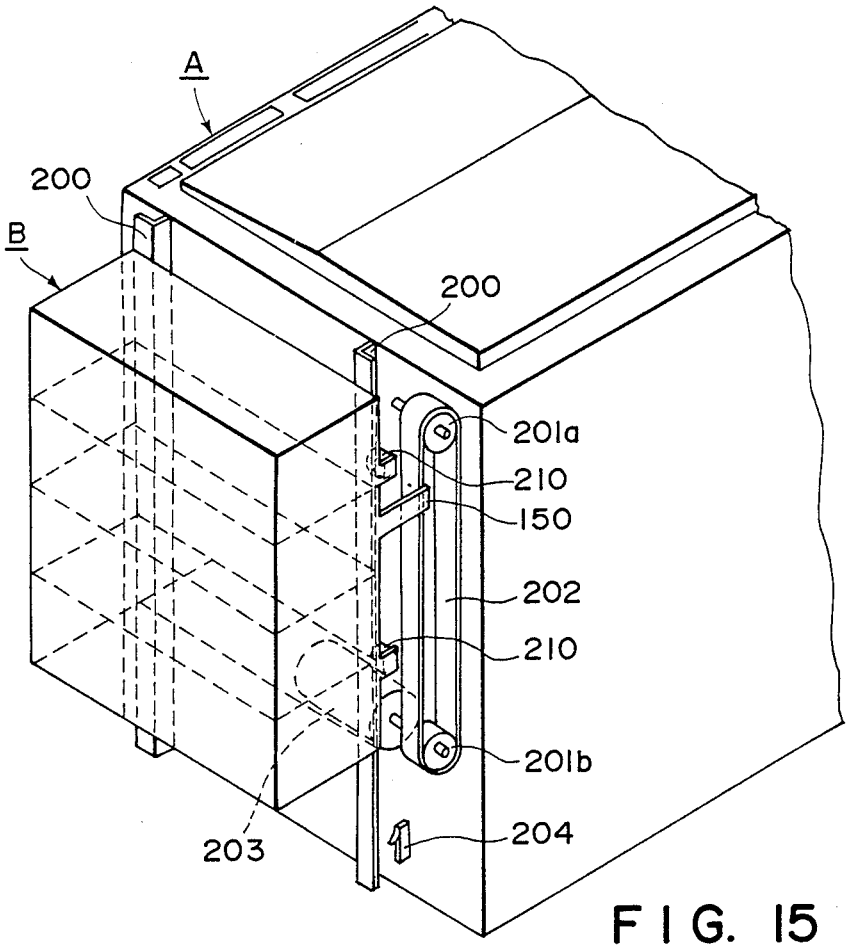
FIG. 15 is a perspective view illustrating a driving means of the developing device accommodating apparatus.

Referring to FIG. 15, a driving means for the accommodating apparatus B will be described. The accommodatin B has plural (four in this embodiment) rollers 210 which are in rolling contact with rails 200 and 200 provided on the main assembly A and which extend substantially vertically and in parallel, so that the entire accommodating apparatus is vertically movable. On the other hand, the main assembly A is provided with two pulleys 201*a* and 201*b* functioning as driving means. A belt 202 is trained around the pulleys 201*a* and 201*b* with a predetermined tension. The accommodating apparatus B is connected to the belt 202 by an arm 150. The lower pulley 201*b* is connected to an output shaft of a reversible pulse motor 203 functioning as a drivng source. At a lower side portion of the main assembly A, a microswitch 204 is provided which is actuated when a predetermined one of the developing devices in the accommodating apparatus B is at a predetermined level, that is, in alignment with the inlet opening.

When one of the developing devices 13A, 13B, 13C and 13D, for example, the green developing device 13C is selected and is used for the developing operation, the accommodating apparatus B is driven by the driving means shown in FIG. 15 in the vertical direction, and when the green developing device 13C comes to the level of the inlet opening 20, the driving means is stopped. Then, the green developing device 13C is aligned with the inlet opening 20. The DC motors 32 and 32 are operated to rotate the gears 33 in the direction of the arrow shown in FIG. 12, by which the green developing device 13C having the racks 31 and 31 in engagement with the gears 33 and 33 is transported toward the photosensitive drum 11 along the guides 23 and 23. Then, the guide members 24 and 24 formed on the bottom of the green developing device 13C are brought into engagement with the guides 22 and 22 in the main assembly A, and the racks 31 and 31 are engaged with the gears 34 and 34 of the main assembly A. When the green developing device 13C advances enough for the racks 31 and 31 to be disengaged from the gears 33 and 33, the unshown motor of the main assembly A is driven so that the gears 34 and 34 are rotated in the direction of the arrow. The green developing device 13C is advanced to the neighborhood of the photosensitive drum 11. When this is detected by an unshown sensor, the DC motor for driving the gears 34 and 34 is stopped. At this time, the pressing cam 25 is at its retracted position shown by broken lines. When, however, the green developing device 13C comes to the position indicated by solid lines, the cam rotates as shown by chain lines to push the rear side of the green developing device 13C, to urge the developing device to the photosensitive drum 11 with a predetermined pressure. The green developing device 13C develops a latent image formed on the photosensitive drum 11 surface.

After the developing operation is completed, the 13C is returned into the green developing device accommodating apparatus B in the reversed manner. By repeating the above described operation, a multi-color superimposed image is formed.

Figure 16:
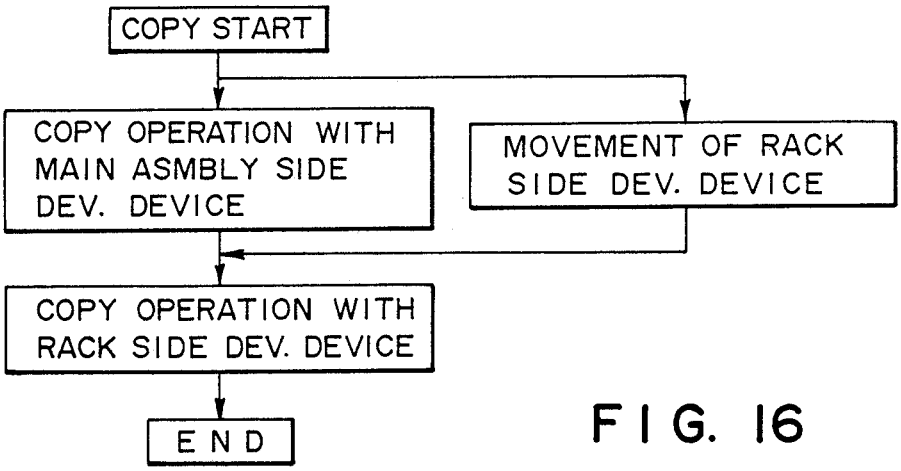
FIG. 16 is a flow chart illustrating an operation of the apparatus of FIG. 11.

In this embodiment, when a multi-color image formation is selected including the black color, more particulary, when the black developing device stationary in the main assembly A and a red developing device 13A in the accommodating apparatus B are selected, the image forming operation starts with the black developing device 14, as shown in the flow chart of FIG. 16. During this image forming operation, the red developing device 13A is fed into the main assembly A so as to allow the red developing device 13A to be operated as soon as the black image forming operation is completed. As will be understood, the red developing device 13A is introduced and placed the main assembly A while the image is being formed in the other selected color, i.e. black, and therefore, the total copy speed can be increased by saving the time of feeding the red developing device 13A.

The foregoing description has been made with respect to the copying machine. However, the present invention is applicable to another image forming apparatus, such as a printer.

As described, according to this embodiment, the stationary developing device is first put into operation, and during the operation of the stationary developing device, the next color developing device is fed into the image forming station of the main assembly, so that the copy speed can be substantially increased.

A further embodiment will be described, wherein similarly to the embodiment of FIG. 11, only one exchangeable developing station is provided. The structures of the main assembly A and the accommodating apparatus B are the same as those in FIGS. 11 and 6, and therefore, the detailed explanation is omitted.

The feature of this embodiment is in the provision of a control system for feeding the developing devices from the one closest to the passage 21.

When, for example, the colors are selected in the order of blue-sepia-green-red, the green developing device 13C is first introduced into the main assembly A, in the state shown in FIG. 11, since the green developing device 13C is closest to the passage 21. The developing device next to be fed is determined in the following manner. First the discrimination is made as to how many developing devices are above the green developing device 13 and below the green developing device 13C. The developing device at the smaller number side is the next fed into the main assembly A. In the state of FIG. 11, there are two developing devices above the green developing device 13C and only one developing device below the green developing device 13C, and therefore, the lower developing device, that is, the sepia developing device 13D the next introduced into the main assembly A. Then, the blue developing device 13B is fed, and then, the red developing device 13A is fed into the main assembly A. If the upper side number and the lower side number are the same, either may be fed first.

The following is an example of the order, for the purpose of comparison, wherein case 1 corresponds to the above described order; in case 2 the blue developing device 13B is fed second; and in case 3 the developing devices are fed in the order of the color selection.

| CASES | ORDER OF FEED | NUMBER OF MOVEMENTS |
|---|---|---|
| 1 | 13C-13D-13B-13A | 4 |
| 2 | 13C-13B-13A-13D | 5 |
| 3 | 13B-13D-13C-13A | 6 |

It will be understood that according to this embodiment of the present invention, the number of vertical movements of the accommodating apparatus B is minimized, whereby the developing device can be fed into the main assembly most efficiently.

Figure 17:
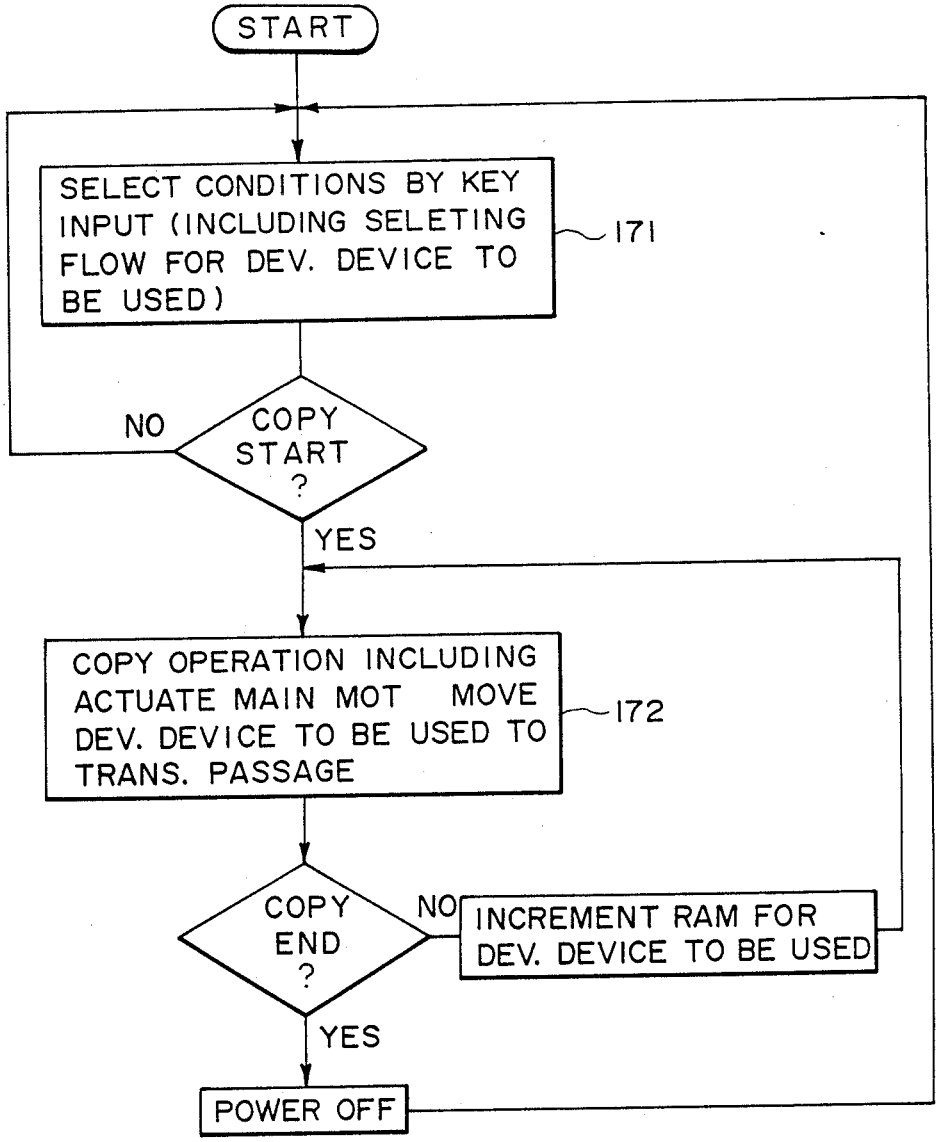
FIG. 17 is a flow chart illustrating an operation in an embodiment wherein the developing device closest to the transportation passage is used first.
Figures 1, 18:
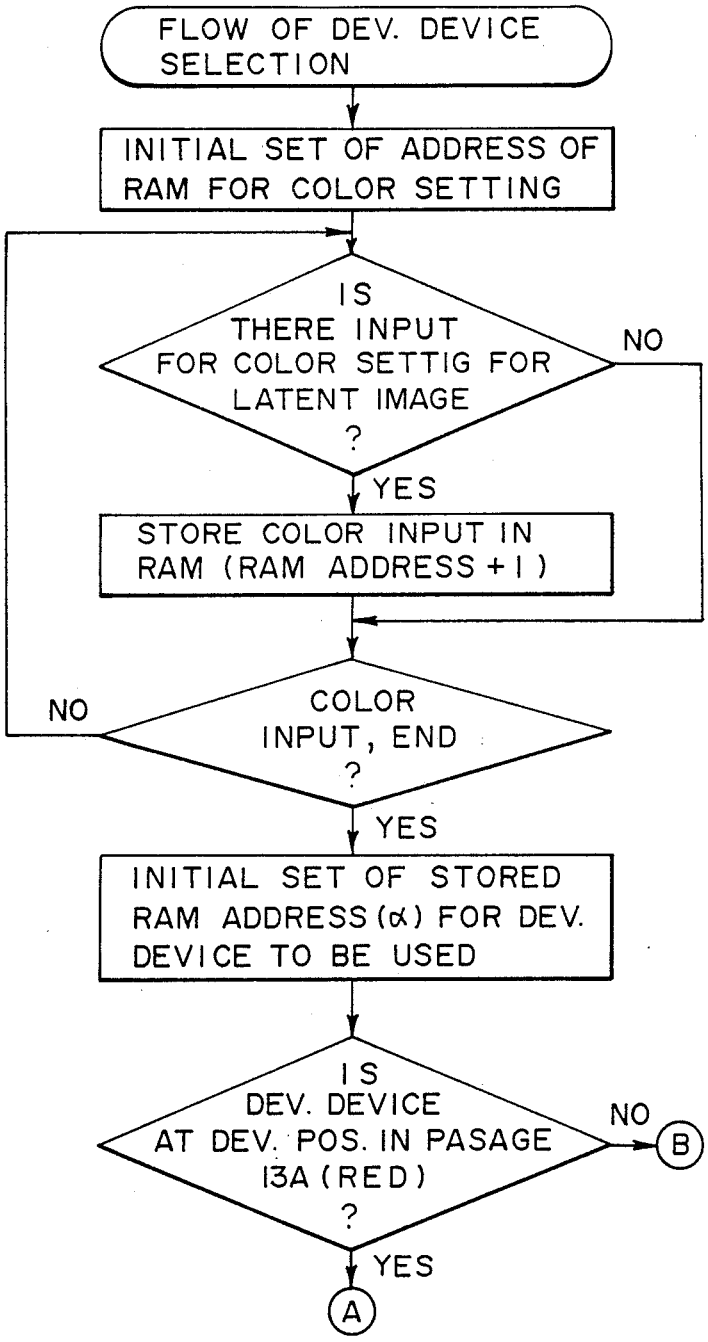
Figures 2, 18:
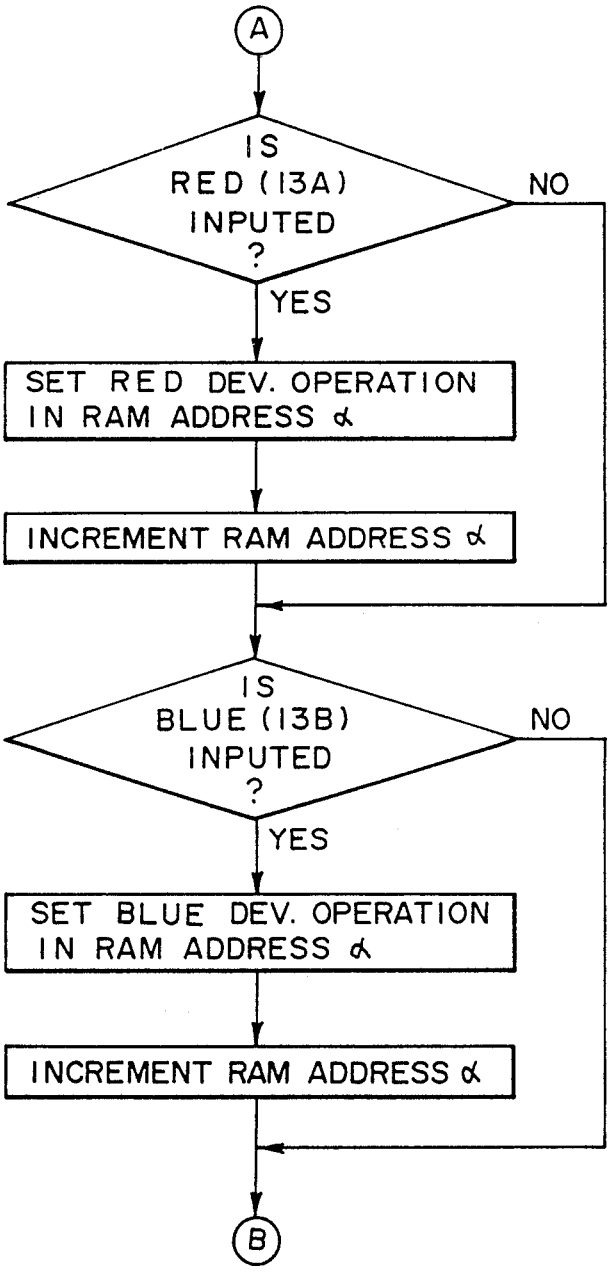
Figures 3, 18:
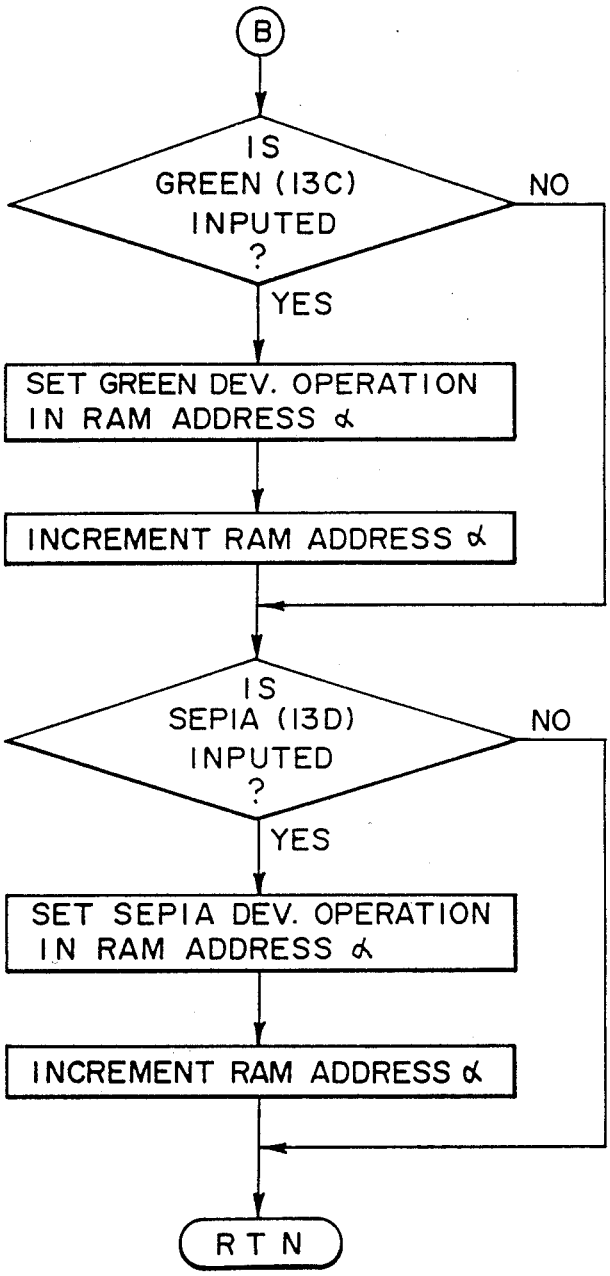
Figures 4, 18:
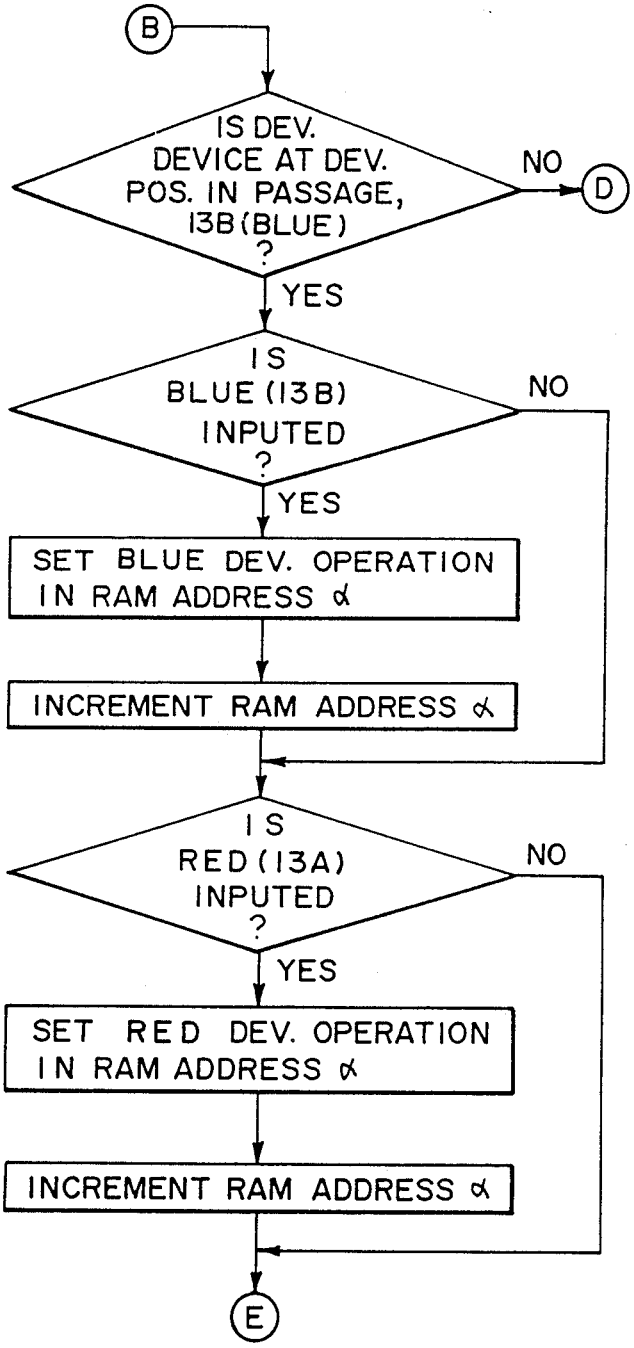
Figures 5, 18:
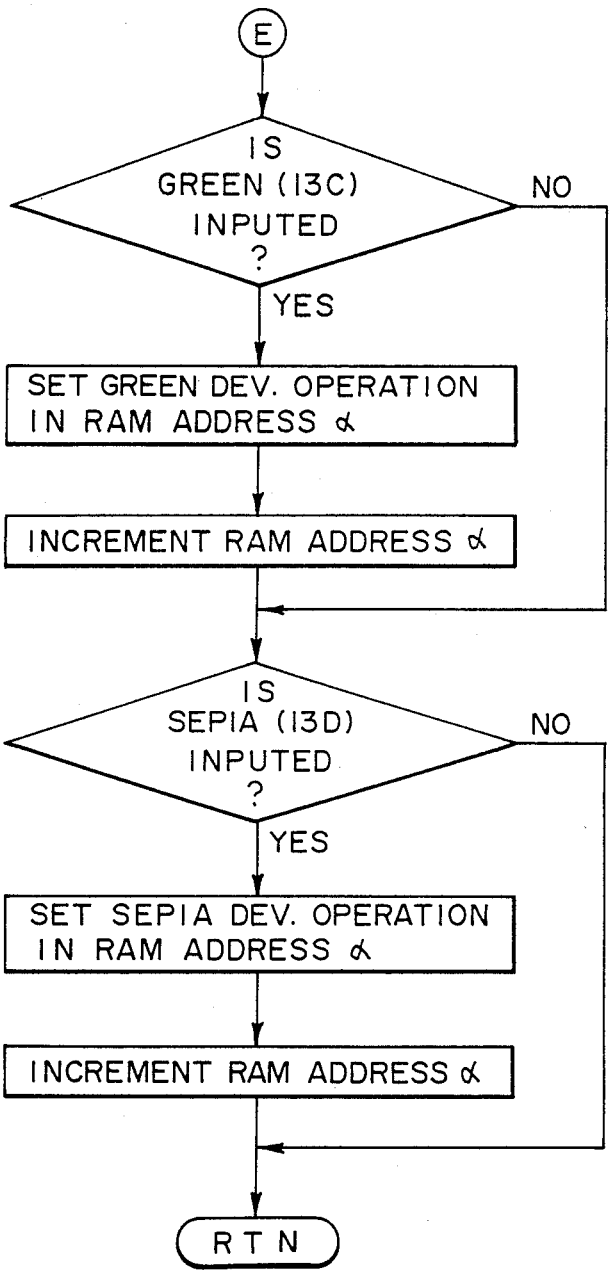
Figures 6, 18:
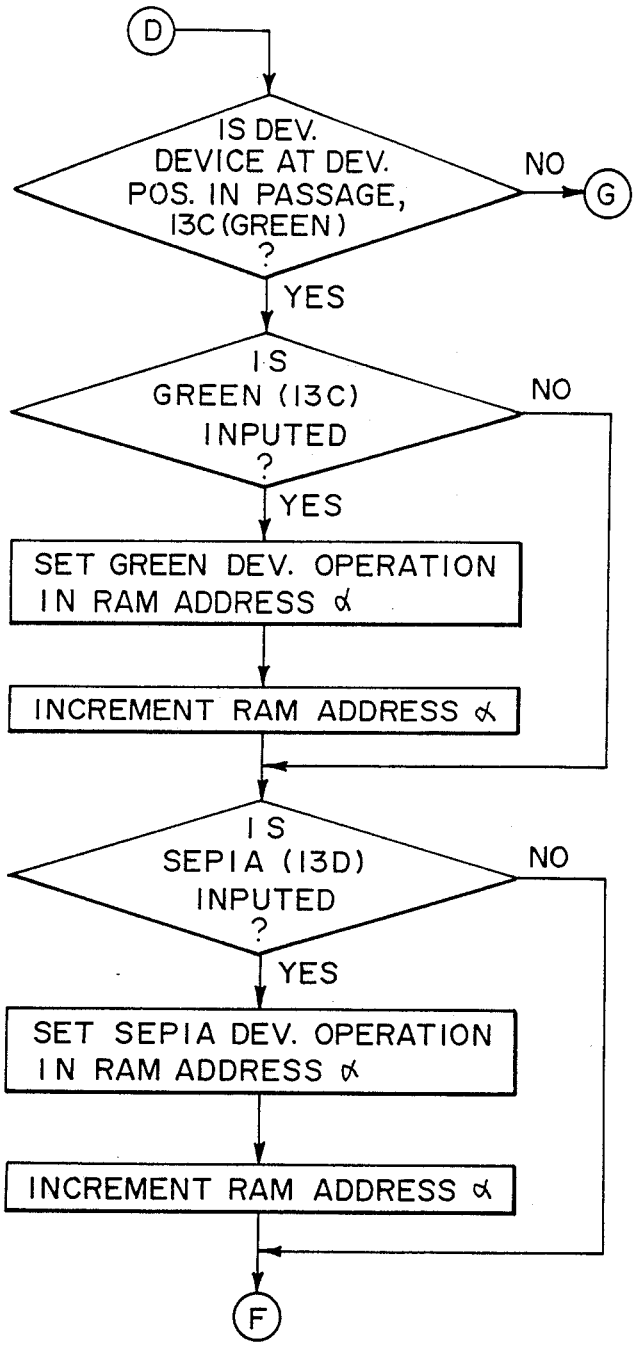
Figures 7, 18:
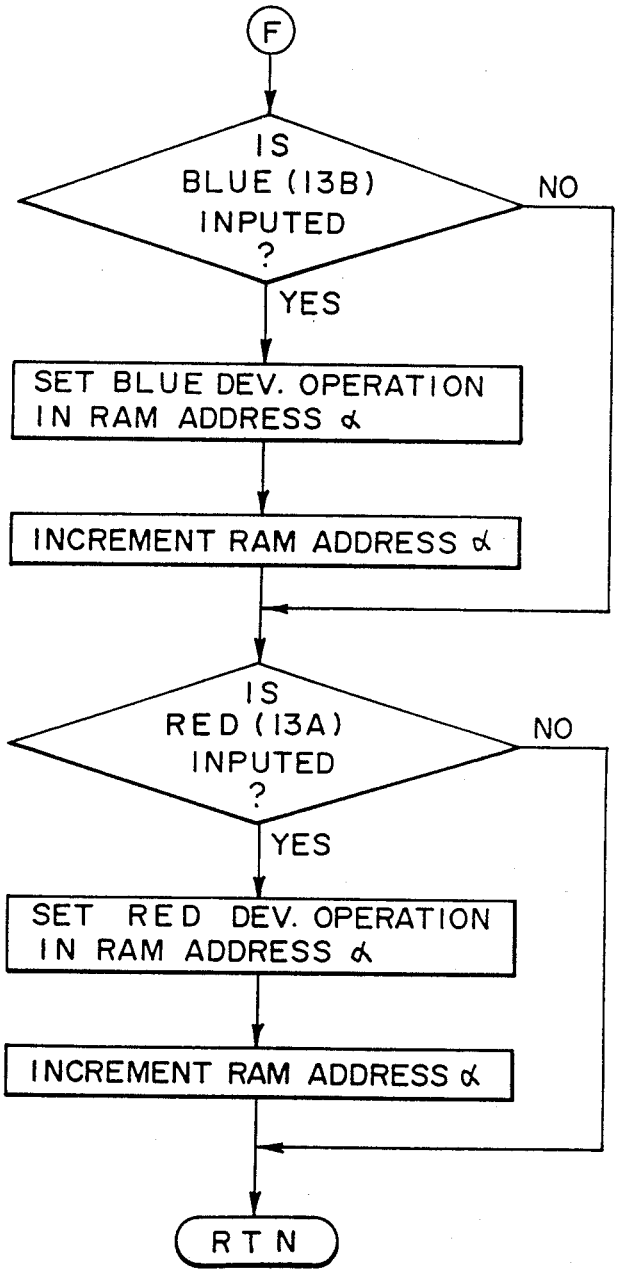
Figures 8, 18:
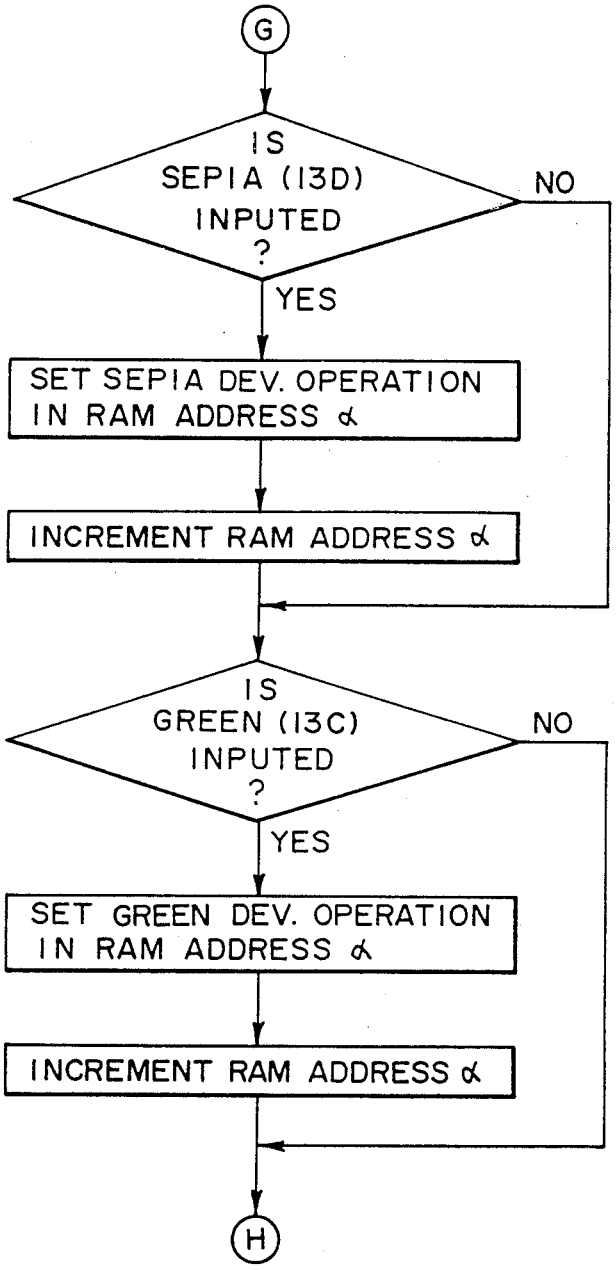
Figures 9, 18:
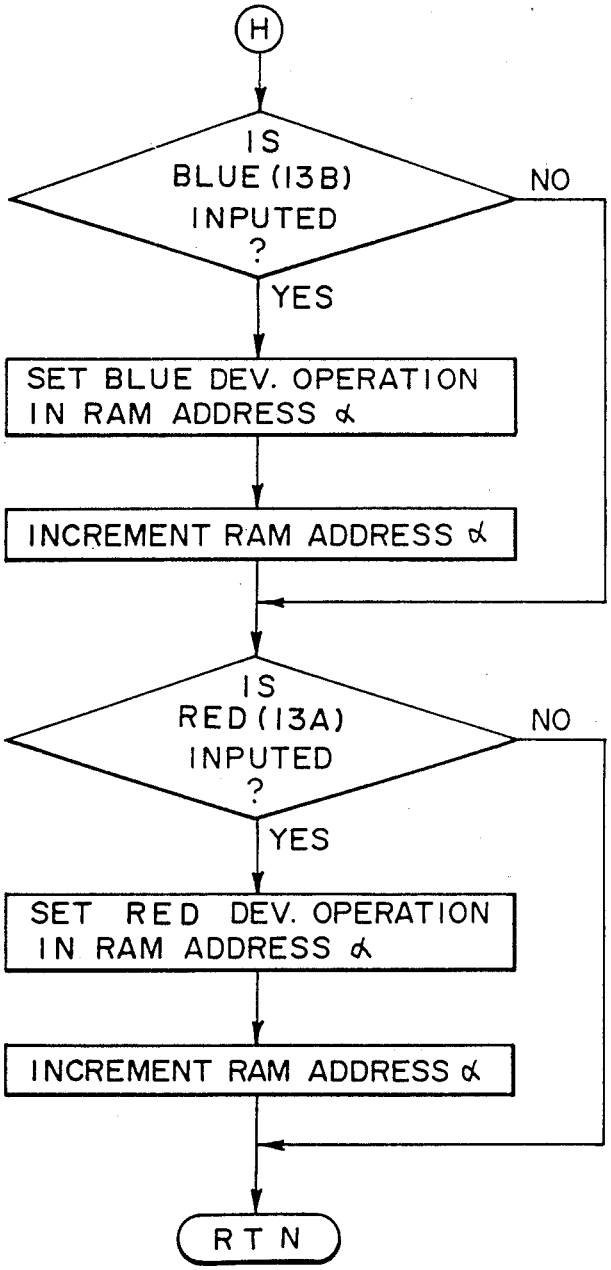

Referring to FIGS. 17 and 18, the control sequence of this embodiment will be described.

At step 171, the colors are selected. At step 172, then the developing device is sequentially exchanged, and the developing operation is performed, as shown in FIGS. 17 and 18. Thus, the number of the movements of the accommodating apparatus is minimized, and therefore, the total copy speed is increased.

While the invention has been described with reference to the structures disclosed herein, it is not confined to the details set forth and this application is intended to cover such modifications or changes as may come within the purposes of the improvements or the scope of the following claims.

What is claimed is:

1. A multi-color image forming apparatus, for forming a superimposed multi-color image on a transfer material, comprising:

a latent image bearing member;

means for forming a latent image on said image bearing member;

plural developing means containing different color developers for developing the latent image in different colors;

means for accommodating said plural developing means;

guiding means for guiding said developing means between a first position within said accommodating means and a second position adjacent said image bearing member;

driving means for moving said developing means between the first position and the second position for exchange of the developing means at the second position;

means for discriminating said plural developing means;

second developing means disposed adjacent said image bearing member at a different position;

wherein when plural colors are selected for development, a discrimination is made as to whether the developing means containing the developer of the selected color is at the second position or not, and if so, the developing means located at the second position is operated before the other of the plural developing means irrespective of the order of the selection.

2. An apparatus according to claim 1, wherein said discriminating means operates for said developing means in said accommodating means.

3. A multi-color image forming apparatus, for forming a superimposed multi-color image on a transfer material, comprising:

a latent image bearing member;

means for forming a latent image on said image bearing member;

plural developing means containing different color developers for developing the latent image in different colors;

means for accommodating said plural developing means;

plural guiding means for guiding said developing means between a first position within said accommodating means and second positions adjacent said image bearing member;

driving means for moving said developing means between the first position and the second position for exchange of the developing means at the second position;

means for discriminating said plural developing means;

wherein when plural colors are selected for development, a discrimination is made as to whether the developing means containing the developer of the selected color is at the second position or not, and if so, the developing means located at the second position is operated before the other of the plural developing means, irrespective of the order of the selection.

4. An apparatus according to claim 5, wherein during an image forming operation by the selected one of the developing means at one of the second positions, the developing means is exchanged in another second position.

5. A multi-color image forming apparatus, for forming a superimposed multi-color image on a transfer material, comprising:

a latent image bearing member;

means for forming a latent image on said image bearing member;

plural developing means containing different color developers for developing the latent image in different colors;

means for accommodating said plural developing means;

guiding means for guiding said developing means between a first position within said accommodating means and a second position adjacent said image bearing member;

driving means for moving said developing means between the first position and the second position for exchange of the developing means at the second position;

means for discriminating said plural developing means;

wherein when plural colors are selected for development, a discrimination is made as to whether the developing means containing the developer of the selected color is at the second position or not, and ,if so, the developing means located at the second position is operated before the other of the plural developing means, irrespective of the order of the selection.

6. A multi-color image forming apparatus, for forming a superimposed multi-color image on a transfer material, comprising:

a latent image bearing member;

means for forming a latent image on said image bearing member;

plural developing means containing different color developers for developing the latent image in different colors;

means for accommodating said plural developing means;

guiding means for guiding said developing means between a first position within said accommodating means and a second position adjacent said image bearing member;

driving means for moving said developing means between the first position and the second position for exchange of the developing means at the second position;

means for discriminating said plural developing means;

wherein when plural colors are selected for development, developing means containing the developer of the selected colors are transported to the second position in the order from the one close to the guiding means.

7. A multi-color image forming apparatus, for forming a superimposed multi-color image on a transfer material, comprising:

a latent image bearing member;

means for forming a latent image on said image bearing member;

plural developing means containing different color developers for developing the latent image in different colors;

means for accommodating said plural developing means;

guiding mean for guiding said developing means between a first position within said accommodating means and a second position adjacent said image bearing member;

driving means for moving said developing means between the first position and the second position for exchange of the developing means at the second position;

means for discriminating said plural developing means;

second developing means disposed adjacent said image bearing member at a different position;

wherein when plural colors are selected for development, a discrimination is made as to whether the developing means containing the developer of the selected color is at the second position or not, and if so, the developing means located at the second position is operated before the other of the plural developing means, irrespective of the order of the selection, and then, developing means containing the developer of the selected colors are transported to the second position in the order from the one close to the guiding means.

* * * * *

UNITED STATES PATENT AND TRADEMARK OFFICE

CERTIFICATE OF CORRECTION

PATENT NO. :4,841,336

DATED :June 20, 1989

INVENTOR(S) :TOSHIHIKO KUSUMOTO, ET AL.

It is certified that error appears in the above-identified patent and that said Letters Patent is hereby corrected as shown below:

IN THE DRAWINGS,
SHEET 17 OF 25

FIG. 18-1, "SETTIG" should read --SETTING-- and "PASAGE" should read --PASSAGE--.

COLUMN 1

Line 39, "tempolarily" should read --temporarily--.

COLUMN 2

Line 10, "o the de-" should read --of the de- --.

COLUMN 3

Line 43, "sca" should read --scan--.

COLUMN 4

Line 1, "nex" should read --next--.
Line 61, "material 17 pass" should read --material 17 to pass--.
Line 67, "guiding plates 43 an" should read --guiding plates 43 and 44,--.

COLUMN 5

Line 41, "When" should read --With--.

UNITED STATES PATENT AND TRADEMARK OFFICE

CERTIFICATE OF CORRECTION

PATENT NO. : 4,841,336

DATED : June 20, 1989

INVENTOR(S) : TOSHIHIKO KUSUMOTO, ET AL.

It is certified that error appears in the above-identified patent and that said Letters Patent is hereby corrected as shown below:

COLUMN 6

Line 56, "deceloping device" should read --developing device--.

COLUMN 7

Line 7, "of photosensitive" should read --of the photosensitive--.
Line 24, "inle" should read --inlet--.
Line 56, "from,its" should read --from its--.

COLUMN 9

Line 26, "slight amount movement" should read --a slight amount of movement--.
Line 50, "cas 151" should read --case 151--.

COLUMN 11

Line 35, "t the" should read --to the--.
Line 45, "accomodating" (second occurrence) should read --accommodating--.

UNITED STATES PATENT AND TRADEMARK OFFICE

CERTIFICATE OF CORRECTION

PATENT NO. :4,841,336

DATED :June 20, 1989

INVENTOR(S) :TOSHIHIKO KUSUMOTO, ET AL.

It is certified that error appears in the above-identified patent and that said Letters Patent is hereby corrected as shown below:

COLUMN 12

Line 21, "developing d" should read --developing device--.
Line 35, "device" should read --devices--.
Line 68, "to" should be deleted and "required," should read --required--.

COLUMN 14

Line 11, "modatin B" should read --modating apparatus B--.
Line 22, "drivng" should read --driving--.
Line 66, "the 13C" should read --the green developing device 13C--.

COLUMN 15

Line 50, "device 13" should read --device 13C--.
Line 57, "13D the" should read --13D is the--.

COLUMN 16

Line 58, "means" should read --means,--.

UNITED STATES PATENT AND TRADEMARK OFFICE

CERTIFICATE OF CORRECTION

PATENT NO. 4,841,336

DATED June 20, 1989

INVENTOR(S) TOSHIHIKO KUSUMOTO, ET AL.

It is certified that error appears in the above-identified patent and that said Letters Patent is hereby corrected as shown below:

COLUMN 17

Line 57, ", if so," should read --if so,--.

Signed and Sealed this

Sixth Day of August, 1991

*Attest:*

*Attesting Officer*

HARRY F. MANBECK, JR.

*Commissioner of Patents and Trademarks*